US008109613B2

(12) United States Patent
Nitta et al.

(10) Patent No.: US 8,109,613 B2
(45) **Date of Patent: *Feb. 7, 2012**

(54) INK SUPPLYING METHOD

(75) Inventors: Noboru Nitta, Tagata-gun (JP); Masashi Shimosato, Izunokuni (JP); Hideaki Nishida, Izunokuni (JP); Isao Suzuki, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/952,494

(22) Filed: Nov. 23, 2010

(65) Prior Publication Data

US 2011/0063381 A1 Mar. 17, 2011

Related U.S. Application Data

(62) Division of application No. 11/617,256, filed on Dec. 28, 2006, now Pat. No. 7,845,784.

(51) Int. Cl.
*B41J 2/18* (2006.01)

(52) U.S. Cl. ..... 347/59

(58) Field of Classification Search ..... 347/22, 347/30, 34, 85, 89

See application file for complete search history.

(56) References Cited

U.S. PATENT DOCUMENTS

| | | | | |
|---|---|---|---|---|
| 4,680,696 | A | 7/1987 | Ebinuma et al. | |
| 5,561,448 | A * | 10/1996 | Kaneko et al. | 347/29 |
| 6,231,174 | B1 * | 5/2001 | Haigo | 347/89 |
| 6,371,607 | B2 | 4/2002 | Wouters et al. | |
| 6,742,882 | B2 * | 6/2004 | Nakamura | 347/89 |
| 7,044,579 | B2 | 5/2006 | Katsuumi | |
| 7,198,361 | B2 | 4/2007 | Hida | |
| 7,399,075 | B2 | 7/2008 | Nomura et al. | |
| 7,597,434 | B2 | 10/2009 | Nitta et al. | |
| 7,845,784 | B2 * | 12/2010 | Nitta et al. | 347/89 |
| 7,874,656 | B2 * | 1/2011 | Ota et al. | 347/85 |

(Continued)

FOREIGN PATENT DOCUMENTS

JP 405330073 * 12/1993

(Continued)

OTHER PUBLICATIONS

U.S. Office Action dated Nov. 12, 2009 corresponding to U.S. Appl. No. 11/617,256, filed Dec. 28, 2006.

(Continued)

*Primary Examiner* — Anh T. N. Vo
(74) *Attorney, Agent, or Firm* — Turocy & Watson, LLP

(57) ABSTRACT

An ink supplying mechanism includes a circulating system that connects an ink jet head having a nozzle, a pressure chamber opposed to the nozzle, and an upstream port and a downstream port that communicate with the pressure chamber, an upstream side tank that communicates with the ink jet head via the upstream port and is capable of storing an ink, a downstream side tank that communicates with the ink jet head via the downstream port and is capable of storing the ink, and a circulating pump that feeds the ink from the downstream side tank back to the upstream side tank. The ink supplying mechanism has a relief valve that is capable of opening and closing at least a liquid surface of the downstream side tank with respect to the atmospheric pressure, closes the relief valve to drive the circulating pump, sets the liquid surface of the downstream side tank to a negative pressure, and feeds the ink from the downstream side tank back to the upstream side tank via a feedback channel to circulate the ink.

13 Claims, 8 Drawing Sheets

U.S. PATENT DOCUMENTS

| | | | |
|---|---|---|---|
| 2002/0118256 | A1 | 8/2002 | Dixon et al. |
| 2005/0007399 | A1 | 1/2005 | Harvey et al. |

FOREIGN PATENT DOCUMENTS

| | | |
|---|---|---|
| JP | 10114081 | 5/1998 |
| JP | 410315491 | 12/1998 |
| JP | 11-138841 | 5/1999 |
| JP | 2000289222 | 10/2000 |
| JP | 2005161633 | 6/2005 |
| JP | 2006-150745 | 6/2006 |
| JP | 2006175651 | 7/2006 |
| WO | 2006030235 | 3/2006 |
| WO | 2006064036 | 6/2006 |
| WO | 2006064040 | 6/2006 |
| WO | 2006064043 | 6/2006 |

OTHER PUBLICATIONS

U.S. Office Action dated Apr. 29, 2010 corresponding to U.S. Appl. No. 11/617,256, filed Dec. 28, 2006.

Japanese Office Action for Japanese Application No. 2007-244368 mailed on Dec. 13, 2011.

* cited by examiner

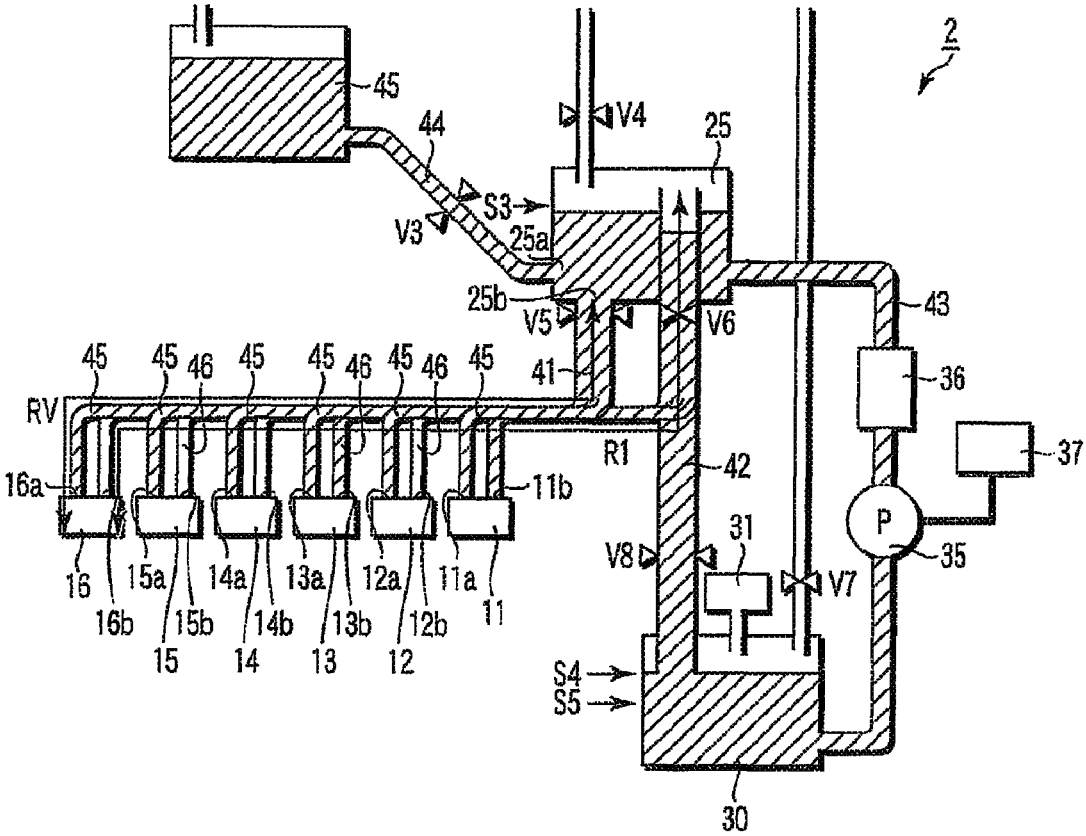
FIG. 7
FIG. 8A
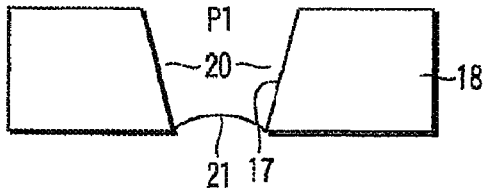
FIG. 8B
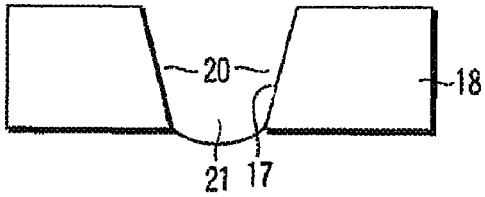
FIG. 8C
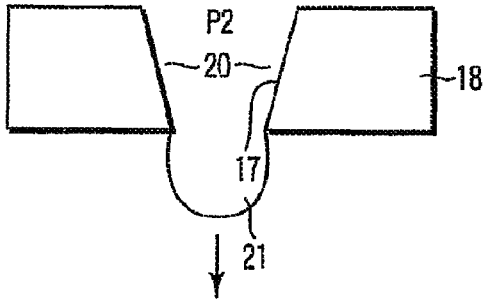

INK SUPPLYING METHOD

CROSS-REFERENCE TO RELATED APPLICATIONS

This application is a Division of U.S. patent application Ser. No. 11/617,256 filed Dec. 28, 2006, the entire contents of which are incorporated herein by reference.

BACKGROUND OF THE INVENTION

1. Field of the Invention

The present invention relates to an ink jet recording apparatus, an ink supplying mechanism, and an ink supplying method for ejecting an ink from an ink jet head while circulating the ink.

2. Description of the Related Art

A technique for ejecting an ink from a nozzle of an ink jet head while circulating the ink in an ink jet recording apparatus is disclosed in, for example, JP-T-2002-533247 (the term "JP-T" as used herein means a published Japanese translation of a PCT patent application) or US 2002/0118256A1. In such an ink jet recording apparatus, for example, an upstream side tank, an ink jet head, and a downstream side tank are connected by a conduit. A liquid surface of the upstream side tank and a liquid surface of the downstream side tank are kept constant. An ink in the upstream side tank circulates to flow into the ink jet head through an upstream side channel and flow into the downstream side tank through a downstream side channel.

In such an ink jet recording apparatus, to prevent deficiencies such as inclusion of air and ink leakage and secure a satisfactory printing characteristic, maintenance of a proper circulation flow rate is demanded. In the technique described above, a circulation flow rate depends on a channel resistance of a channel extending from the upstream side tank to the downstream side tank via the upstream side channel, the ink jet head, and the downstream side channel and a difference between the height of the upstream side tank and the height of the downstream side tank. Therefore, in order to adjust the flow rate, it is necessary to adjust the flow rate according to positions of the upstream side tank, the downstream side tank, the ink jet head, and the like. In other words, for example, in order to increase the flow rate, it is necessary to increase the difference between the height of the upstream side tank and the height of the downstream side tank. Thus, the upstream side tank has to be lifted and the downstream side tank has to be lowered. However, usually, since an arrangement of tanks is often physically limited, it is difficult to adjust the heights. Further, since the channel resistance changes according to the change of the difference between the heights, it is difficult to secure a desired flow rate.

On the other hand, in the ink jet head, in order to secure the satisfactory printing characteristic, an ink pressure near the nozzle is extremely important. It is necessary to keep the ink pressure near the nozzle in a proper range. However, in the technique described above, when there is no ejection of the ink or an ejection quantity of the ink is small, the ink pressure near the nozzle depends on a channel resistance of a channel extending from the upstream side tank to the nozzle in the ink jet head via the upstream side channel, a channel resistance of a channel extending from the nozzle in the ink jet head to the downstream side tank via the downstream side channel, and the heights of the liquid surfaces of the upstream side tank and the downstream side tank. Therefore, in order to obtain an ink pressure in an appropriate nozzle position, it is necessary to adjust the height of the upstream side tank and the height of the downstream side tank. Consequently, the physical limitation on the arrangement of tanks and the change of channel lengths make it difficult to adjust the heights.

BRIEF SUMMARY OF THE INVENTION

According to an aspect of the invention, there is provided an ink supplying mechanism including a circulating system that connects an ink jet head having a nozzle, a pressure chamber opposed to the nozzle, and an upstream port and a downstream port that communicate with the pressure chamber, an upstream side tank that communicates with the ink jet head via the upstream port and is capable of storing an ink, a downstream side tank that communicates with the ink jet head via the downstream port and is capable of storing the ink, and a circulating pump that feeds the ink from the downstream side tank back to the upstream side tank. The ink supplying mechanism has a relief valve that is capable of opening and closing at least a liquid surface of the downstream side tank with respect to the atmospheric pressure, closes the relief valve, drives the circulating pump, sets the liquid surface of the downstream side tank to a negative pressure, and feeds the ink from the downstream side tank back to the upstream side tank via a feedback channel to circulate the ink.

Objects and advantages of the invention will become apparent from the description which follows, or may be learned by practice of the invention.

BRIEF DESCRIPTION OF THE DRAWING

The accompanying drawings illustrate embodiments of the invention, and together with the general description given above and the detailed description given below, serve to explain the principles of the invention.

FIG. 7 is a diagram showing the operation of the ink jet recording apparatus according to the second embodiment;

FIG. 8A is a sectional view showing an ink drop condition around a nozzle according to the second embodiment;

FIG. 8B is a sectional view showing the ink drop condition around the nozzle according to the second embodiment;

FIG. 8C is a sectional view showing the ink drop condition around the nozzle according to the second embodiment;

DETAILED DESCRIPTION OF THE INVENTION

First Embodiment

Figure 1:
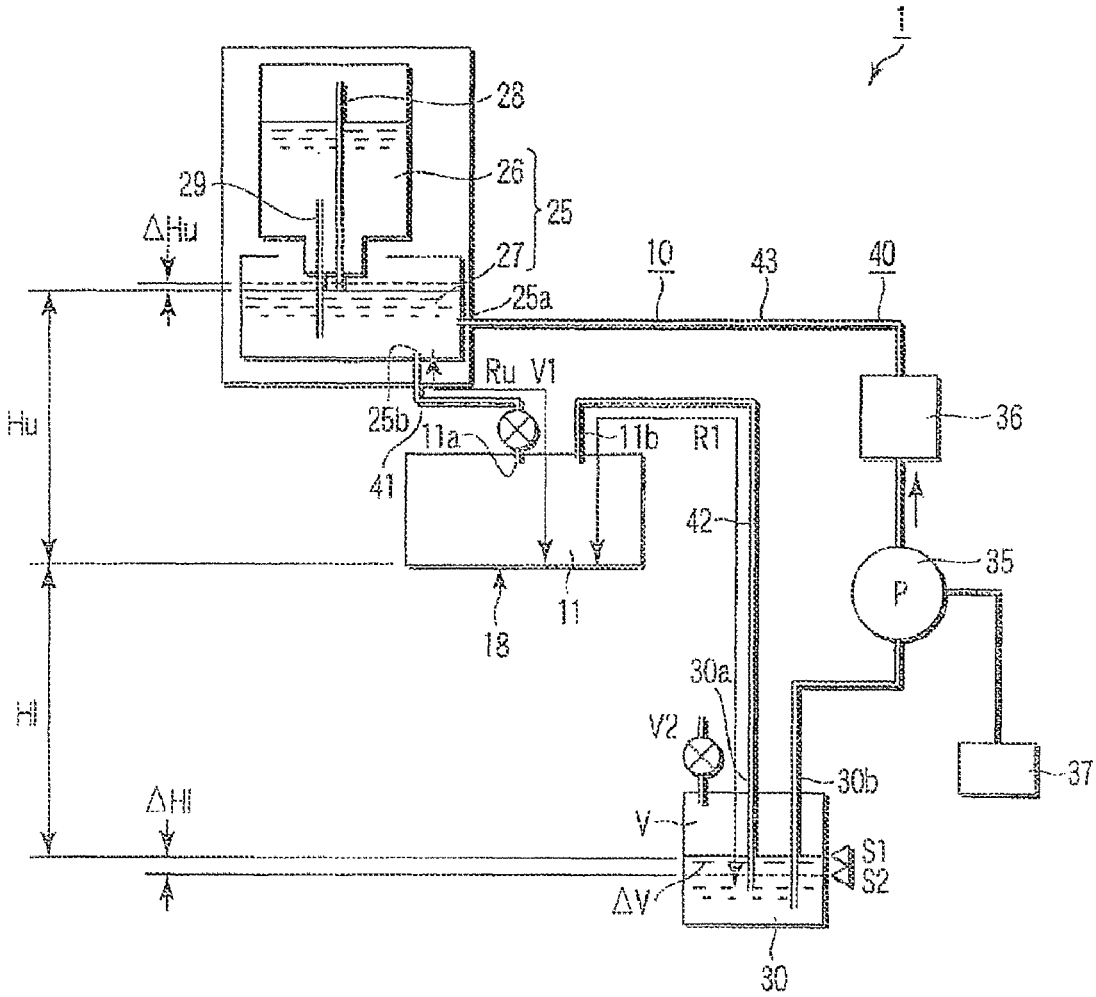
FIG. 1 is a diagram schematically showing an overall structure of an ink jet recording apparatus according to a first embodiment of the invention.

An ink jet recording apparatus and an ink supplying method according to an embodiment of the invention will be hereinafter explained with reference to FIGS. 1 and 2. In the figures, components are schematically shown by enlarging, reducing, or simplifying the components as appropriate. An ink jet recording apparatus 1 forms an image by ejecting an ink on a not-shown recording medium from a nozzle 17 of an ink jet head 11 while circulating the ink. The ink jet recording apparatus 1 includes an ink supplying mechanism 10. The ink supplying mechanism 10 includes the ink jet head 11, an upstream side tank 25 serving as an ink supply source, a downstream side tank 30 that stores the ink, a first conduit 41, a second conduit 42, and a third conduit 43 that connect the ink jet head 11, the upstream side tank 25, and the downstream side tank 30 and form a circulation path for the ink, a circulating pump 35 serving as an ink sending mechanism that circulates the ink, and a filter 36.

Figure 2:
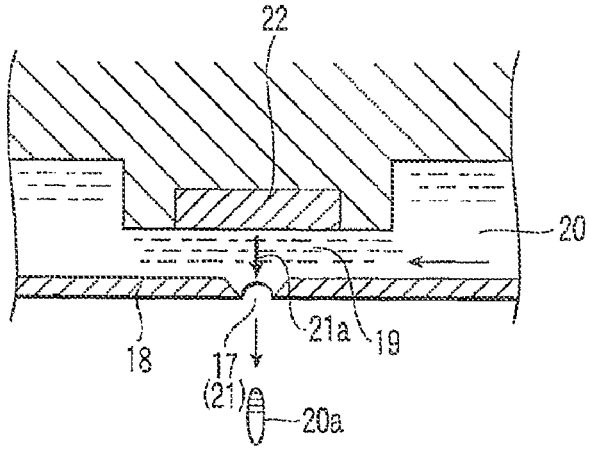
FIG. 2 is a partial sectional view showing a structure around a nozzle of an ink jet head according to the first embodiment.

The ink jet head 11 shown in FIG. 2 includes an orifice plate 18 having the nozzle 17. A pressure chamber 19 opposed to the nozzle 17 is formed on the rear side of the orifice plate 18. An ink 20 circulates through the pressure chamber 19. The pressure chamber 19 is formed narrower than a circulation path that communicates with the conduits. An actuator 22 is provided in the pressure chamber 19 formed on the opposite surface side of the nozzle 17 in FIG. 2. In the pressure chamber 19, when the actuator 22 is driven, an ink droplet 20*a* is ejected from the nozzle 17. As the actuator 22, for example, an actuator that directly or indirectly deforms a pressure chamber using a piezoelectric element such as a PZT, an actuator that drives a diaphragm with static electricity, an actuator that directly moves an ink with static electricity, or an actuator that heats an ink with a heater to generate air bubbles and generate a pressure is used. However, the actuator 22 is not limited to these actuators. The ink jet head 11 has an upstream port 11*a* and a downstream port 11*b*. The upstream port 11*a* of the ink jet head 11 is connected to the upstream side tank 25 via the first conduit 41. The downstream port 11*b* is connected to the downstream side tank 30 via the second conduit 42. In the ink jet head 11 constituted as described above, the ink 20 flows from the right to the left, for example, as indicated by an arrow in FIG. 2, through the pressure chamber 19.

As shown in FIG. 1, the upstream side tank 25 is arranged above the ink jet head 11. The upstream side tank 25 has an ink inlet 25*a* and an ink outlet 25*b* and has a function as an ink supply source for supplying an ink. The upstream side tank 25 includes an upper tank 26 and a lower tank 27. A liquid surface of the lower tank 27 is opened to the atmosphere. The upstream side tank 25 is connected to the upstream port 11*a* of the ink jet head 11 via the first conduit 41. The upper tank 26 is a replaceable bottle. When the ink in the upper tank 26 is exhausted, a user replaces the upper tank 26 with a new ink-filled bottle. The upper tank 26 and the lower tank 27 are connected via a ventilation pipe 28 and an ink supply pipe 29. As the ink is consumed from the ink jet head 11, the liquid surface of the lower tank 27 lowers and the bottom end of the ventilation pipe 28 separates from the liquid surface of the lower tank 27. At this point, the air is led into the upper tank 26 through the ventilation pipe 28, the bottom end of which is exposed. When the ink pushed out by this air in the upper tank 26 falls into the lower tank 27 through the ink supply pipe 29, the liquid surface of the lower tank 27 rises. According to the rise of the liquid surface of the lower tank 27, the liquid surface of the lower tank 27 reaches the bottom end of the ventilation pipe 28. Then, since the ventilation pipe 28 is closed, the inflow of the air into the upper tank 26 stops and the supply of the ink is cut off. In this way, the ink is supplied and the liquid surface of the lower tank 27 is controlled.

When there is a margin in a setting range of a proper pressure near the nozzle 17, i.e., the pressure chamber 19 in the ink chamber of the ink jet head 11 (an average excluding a high-frequency component generated by the actuator for an ink ejection operation), the height of the liquid surface does not have to be strict. In this case, it is possible to suppress a change in the height of the liquid surface with respect to a change in a volume by using a shallow container with a large cross section as the upstream side tank 25. In that case, when the ink in the upstream side tank 25 decreases, the user may directly supply an ink to the upstream side tank 25. The structure of the replaceable bottle does not have to be provided.

The ink in the upstream side tank 25 is supplied to the upstream port 11*a* of the ink jet head 11 via the first conduit 41. A valve V1 (an opening and closing mechanism) that is capable of opening and closing the circulation path is provided in the first conduit 41. The valve V1 is closed when the supply of the ink is stopped but is opened during the normal operation.

The downstream side tank 30 is an ink tank having the ink inlet 30*a* and an ink outlet 30*b*. The downstream side tank 30 stores an ink and has a function as a pressure source. The downstream side tank 30 is arranged below the ink jet head 11. The ink inlet 30*a* is connected to the downstream port 11*b* of the ink jet head 11 via the second conduit 42. The ink outlet 30*b* is connected to the upstream side tank 25 via the third conduit 43 including the circulating pump 35 and the filter 36. The circulating pump 35 has a function of circulating the ink 20 by pumping up the ink in the downstream side tank 30, filtering the ink with the filter 36, and pumping up the ink to the upstream side tank 25 via the third conduit 43. For example, like a tube pump, the circulating pump 35 closes when circulation is stopped. The same function may be realized by connecting a diaphragm pump and a check valve in series. The circulating pump 35 is controlled by, for example, ON/OFF control or speed control.

The downstream side tank 30 has an air layer in an upper part thereof. An openable and closable valve V2 (a pressure adjusting mechanism) is provided above this air layer. By opening and closing the valve V2 with a control unit 37, it is possible to selectively open to the atmosphere pressure, or close the liquid surface of the downstream side tank 30. Two liquid surface sensors S1 and S2 (liquid surface detectors) are provided in the downstream side tank 30. The liquid surface sensors S1 and S2 have a function of detecting whether the liquid surface of the ink in the tank has reached a first level and a second level set in advance, respectively. When the liquid surface is at the first level, a volume of the air layer of the downstream side tank 30 is V. When the liquid surface is at the second level, a volume of the air layer of the downstream side tank 30 is V+ΔV.

The insides of the upstream side tank 25, the downstream side tank 30, the first conduit 41, the second conduit 42, the third conduit 43, and the pressure chamber 19 communicate with one another to form a circulation path 40. Not-shown air filters for preventing inclusion of foreign matters are provided in atmosphere opening sections of these components. When the ink tends to evaporate, mechanisms such as mazes for preventing evaporation may be provided in the atmosphere opening sections of the respective components.

A flow rate of the circulating pump 35 is set to, for example, 120% of a maximum circulation flow rate planned. A difference of levels of the liquid surface of the upstream side tank 25 and the orifice plate surface 18 of the ink jet head 11 is Hu and a difference of levels of the liquid surface of the downstream side tank 30 and the orifice plate 18 surface of the ink jet head 11 is Hl.

A channel resistance from the tip of the first conduit 41 in the upstream side ink tank 25 to the neighborhood of the nozzle 17 in the ink chamber of the ink jet head 11, i.e., a channel resistance in an upstream side channel is Ru. A channel resistance from the neighborhood of the nozzle 17 in the ink chamber of the ink jet head 11 to the tip of the second conduit 42 in the downstream side tank 30, i.e., a channel resistance of a downstream side channel is Rl. For simplification of the following explanations, it is assumed that Ru and Rl include a channel resistance in the ink jet head 11.

In this embodiment, since cross sections of the respective tanks 25 and 30 are sufficiently large, channel resistances from the liquid surfaces in the tanks to connection points of the conduits 41 and 42 are usually negligible. If the channel resistances are not negligible, the channel resistances only have to be added to Ru and Rl, respectively.

When the ink jet head 11 has a branch at a middle point of a circulation channel in the inside thereof and has the nozzle 17 at the end of the branch, Ru only has to be considered a channel resistance from the upstream side tank 25 to this branch point and Rl only has to be considered a channel resistance from the branch point to the downstream side tank 30.

Values of Rl and Ru are products of a constant depending on a physical shape of a channel and a viscosity of an ink. It is assumed that the ink is a nonvolatile oil ink having a specific gravity ρ. A gravitational acceleration is g and the atmospheric pressure is Patm.

It is assumed that an ejection flow rate is sufficiently low compared with a circulation flow rate. In this case, pressure losses in the ink supplying mechanism 10 and the ink jet head 11 depend on the circulation flow rate more than the ejection flow rate. In general, a dynamic pressure due to a circulation flow near the nozzle 17 at the bottom end of the ink jet head 11 is sufficiently low and negligible. In such an ink supply mechanism 10, usually, a Reynolds number is sufficiently small and an influence of a turbulent flow is negligible.

An operation of an initial supply of an ink in the ink jet apparatus 1 will be explained.

In an initial state, an ink is supplied to the upstream side tank 25, and then the valve V1 is opened and the circulating pump 35 is stopped. When the valve V2 is opened in this state, the ink flows into the downstream side tank 30 from the upstream side tank 25 through the first conduit 41, the ink jet head 11, and the second conduit 42.

In this case, by closing the tip of the nozzle 17 with a not-shown closing cap until the initial supply is finished, it is possible to prevent the ink from flowing out from the nozzle 17 of the ink jet head 11. When all conditions that a pressure ρgHu is low, a diameter of the nozzle 17 is small, and the ink does not adhere to the surface of the orifice plate 18 are satisfied, the ink does not flow out from the nozzle 17 even if the closing cap is not used. Thus, in such a case, the closing cap does not have to be provided.

When the ink accumulates in the downstream side tank 30 and a liquid surface sensor S1 detects that the liquid surface exceeds the first level, which is a low level reference, the circulating pump 35 operates according to the control by the control unit 37 corresponding to a result of the detection. The ink is fed from the downstream side tank 30 to the upstream side tank 25. Thereafter, while the liquid surface exceeds the first level, the circulating pump 35 operates. The liquid surface of the upstream side tank 25 slightly rises according to the operation of the circulating pump 35. However, this change is sufficiently small and negligible.

In this state, a circulating flow of the ink is generated. In the circulating flow, the ink flows from the upstream side tank 25 through an upstream side channel including the first conduit 41, the ink jet head 11 and a downstream side channel including the second conduit 42 and returns to the upstream side tank 25 through a feedback channel including the circulating pump 35, the filter 36, and the third conduit 43. The circulating pump 35 operates intermittently. A circulation flow rate in this case is determined by Hu, Hl, Ru, Rl, ρ, and g. When a value of the circulation flow rate is Q1, $Q1=\rho g(Hu+Hl)/(Ru+Rl)$.

A pressure near the nozzle 17 is determined by Hu, Hl, Ru, Rl, ρ, and g. When a value of the pressure is Pn1 (gage pressure), $Pn1=\rho gHu-(\rho g(Hu+Hl)(Ru/(Ru+Rl))$.

In this case, Pn1 is set to, for example, about −0.1 kPa to prevent the ink from overflowing the nozzle 17. Q1 is set to a value smaller than a planned circulation flow rate. This state is a low-speed circulation state. Since Q1 is smaller than the planned circulation flow rate, a position of the downstream side tank 30 does not have to be lowered by a great degree. Therefore, even if there is a physical limitation, it is possible to easily constitute the ink jet recording apparatus 1.

An operation for increasing a circulation flow rate and reducing a pressure near the nozzle 17 to a value suitable for ink ejection (increasing an absolute value) will be explained.

The valve V2 that opens the air layer of the downstream side tank 30 to the atmospheric pressure is closed and the circulating pump 35 is caused to operate until the liquid surface in the downstream side tank 30 reaches the second level. When it is detected by the liquid surface sensor S2 that the liquid surface of the downstream side tank 30 is lower than the second level, the circulating pump 35 is stopped. Thereafter, the circulating pump 35 is caused to operate only while the liquid surface of the circulating pump 35 exceeds the second level. In this case, the liquid surface of the downstream side tank 30 lowers by ΔHl and the liquid surface of the upstream side tank 25 rises by ΔHu. These values are sufficiently small compared with Hl and Hu. A change in potential heads for ΔHl and ΔHu is sufficiently small and negligible.

At a point when the valve V2 is closed, the air layer of the downstream side tank 30 has a volume V. Since the liquid surface is lowered from this state, the volume of the air layer of the downstream side tank 30 increases to V+ΔV. Therefore, the air layer of the downstream side tank 30 is decompressed. When a gauge pressure in the air layer of the downstream side tank 30 in this state is PL (a negative value), PL=−(ΔV/(V+ΔV))Patm. Patm is the atmospheric pressure.

When a circulation flow rate in this case is Q2, Q2=(ρg(Hu+Hl)−PL)/(Ru+Rl)=Q1+(−PL/(Ru+Rl)). In other words, the circulation flow rate increases from Q1 by (−PL/(Ru+Rl)).

When a pressure near the nozzle 17 is Pn2 (a gage pressure), Pn2=ρgHu−(ρg(Hu+Hl)−PL)(Ru/Ru+Rl)=Pn1+PL(Ru/(Ru+Rl). In other words, the pressure near the nozzle 17 shifts to a negative pressure side from Pn1 by −PL(Ru/(Ru+Rl)).

Q2 should be set to a target proper circulation flow rate and Pn2 should be set to a proper pressure near the nozzle 17. A proper value of the circulation flow rate is set in, for example, a range of one to twenty times as high as a maximum flow rate at the time of printing. A proper value of the pressure near the nozzle 17 is set in, for example, a range of pressures equal to or lower than 0 kPa and equal to or higher than −3 kPa.

When the circulation is stopped and the circulating pump 35 is put on standby while the pressure near the nozzle 17 is kept in the proper range, the circulating pump 35 is caused to operate as follows. First, the valve V2 is opened and an operation condition of the circulation pump 35 is fed back to the liquid surface sensor S1 to set a reference level to the first level. In this way, the ink circulation system shifts from a high-speed circulation state to a low-speed circulation state. The valve V1 is closed slowly. As a result, the pressure near the nozzle 17 falls gradually. In this case, since the pressure near the nozzle 17 is a negative value, an absolute value thereof becomes large. When a convergent value of the pressure near the nozzle 17 in this case is Pn3 (a gage pressure), Pn3=−ρgHl. Pn3 is set to, for example, −3 kPa.

The ink jet recording apparatus 1 or the ink supplying mechanism 10 according to this embodiment has effects described below. It is possible to adjust a circulation flow rate and a pressure near the nozzle to proper values according to adjustment of the circulating pump 35 and internal pressures of the tanks. Therefore, even when there is a limitation on the arrangement of the ink jet head 11 and the tanks 25 and 30, it is possible to secure a proper flow rate and a proper pressure. In other words, even if a position of the downstream side tank 30 changes and a potential head of the liquid surface of the downstream side tank 30 with respect to the surface of the orifice plate 18 of the ink jet head 11 changes, it is possible to obtain a desired circulation quantity and a desired nozzle pressure by, according to the change, changing a difference between the heights of the liquid surface sensors S1 and S2 and adjusting a pressure in the air layer of the downstream side tank 30 at the time when the valves are closed. Thus, it is easy to arrange the downstream side tank 30 in a position advantageous in terms of a structure.

Even if the downstream side tank 30 is located above the ink jet head 11, if a difference between the heights of the liquid surface sensors S1 and S2 is set large and a negative pressure in the air layer of the downstream side tank 30 is set to a proper value, it is possible to obtain a desired circulation quantity and a desired nozzle pressure.

Moreover, it is possible to enjoy benefits of a circulation system by adjusting a circulation flow rate according to a situation, using the low-speed circulation state and the high-speed circulation state according to the situation, and maintaining a pressure near the nozzle at a proper pressure. In other words, the likelihood of stagnation and precipitation of the ink is reduced, and the temperature of the system is stabilized, and if filtering, degassing, and deforming are performed during circulation, it is possible to modify the ink to be more suitable for fly of ink jet according to circulation. Even if air bubble are generated somewhere in the system, it is possible to increase a circulation flow rate to a degree enough for pushing the air bubbles to the downstream side tank 30 and releasing the air bubbles. On the other hand, by setting the circulation flow rate not to be too high, it is possible to prevent inclusion of the air in a negative pressure section and foaming on a gas-liquid interface from being caused and prevent air bubbles, particles, and the like in the ink from being sent to near the nozzle of the head and prevent a shear stress from being applied to the ink to affect stability of the ink when the ink passes a narrow section of a channel.

Second Embodiment

An ink jet recording apparatus 2 according to a second embodiment of the invention will be explained with reference to FIGS. 3 to 10. In the figures, components are schematically shown by enlarging, reducing, or simplifying the components as appropriate. Explanations of components same as those in the first embodiment are omitted.

Figure 3:
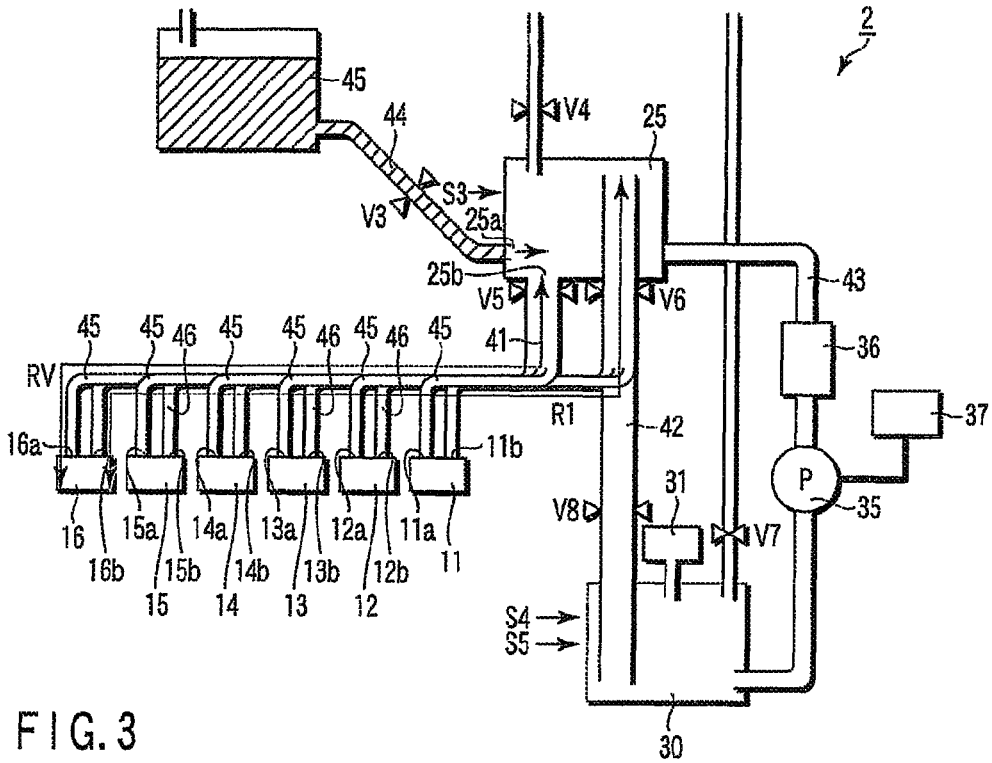
FIG. 3 is a diagram schematically showing an overall structure of an ink jet recording apparatus according to a second embodiment of the invention.

The ink jet recording apparatus 2 shown in FIG. 3 includes plural ink jet heads 11 to 16, the upstream side tank 25 serving as an ink supply source, the downstream side tank 30 that stores an ink, and a supply tank 45 that supplies the ink to the upstream side tank 25.

The plural (six) ink jet heads 11 to 16 have the same structure as the ink jet head 11 according to the first embodiment.

The upstream side tank 25 and the supply tank 45 are connected via a fourth conduit 44 that has a valve V3, which is capable of opening and closing, in the middle. The supply tank 45 is located above the upstream side tank 25 and the fourth conduit 44 is arranged to be inclined downward from the supply tank 45 to the upstream side tank 25.

The supply tank 45 may be a replaceable cartridge like the upper tank 26 in the first embodiment or may be a tank in which an ink is poured from above. An internal pressure of the supply tank 45 is opened to the atmospheric pressure. The ink in the supply tank 45 is poured into the upstream side tank 25 through the fourth conduit 44.

The upstream side tank 25 has an air layer in the upper part thereof. An openable and closable valve V4 is provided above this air layer. By opening and closing the valve V4 with the control unit 37, it is possible to selectively open or close the liquid surface of the upstream side tank 25 with respect to the atmosphere pressure.

A liquid surface sensor S3 is provided in the upstream side tank 25. The liquid surface sensor S3 has a function of detecting whether the liquid surface of the ink in the tank has reached a third level set in advance. Since the valve V3 is opened and closed according to the control by the control unit 37 corresponding to a result of the detection by the liquid surface sensor S3, it is possible to adjust a flow state of the ink. Consequently, the liquid surface of the lower tank of the upstream side tank 25 is maintained constant.

A valve V5, which is capable of opening and closing the circulation path, is provided in the first conduit 41 extending vertically to the bottom of the upstream side tank 25. The first conduit 41 below the valve V5 is formed as a columnar pipe having an internal diameter of 6 mm and length of 5 mm. The first conduit 41 of the columnar pipe shape is divided into six below the valve V5 to form fifth conduits 45. The six fifth conduits 45 are connected to upstream ports 11*a* to 16*a* of the six ink jet heads 11 to 16, respectively. The fifth conduits 45 are formed to extend horizontal or slightly lower and not to rise from the dividing sections to the upstream ports 11*a* to 16*a* of the ink jet heads 11 to 16.

The second conduit 42 that connects the upstream side tank 25 and the downstream side tank 30 is formed in a columnar pipe shape having an internal diameter of 6 mm like the first conduit. An openable and closable valve V6 is provided in the second conduit 42. The second conduit 42 is divided into six sixth conduits 46 below the valve V6. The six sixth conduits 46 are connected to downstream side ports 11*b* to 16*b* of the ink jet heads 11 to 16, respectively. The sixth conduits 46 are formed to extend horizontal or slightly rise and not to lower from the downstream side ports 11*b* to 16*b* of the ink jet heads 11 to 16 to the dividing sections.

The six ink jet heads 11 to 16 have the width of 50 mm, respectively. Therefore, when all the six ink jet heads 11 to 16 are used, it is possible to perform printing with the width of 300 mm. Internal diameters and lengths of the six fifth conduits 45 are ϕ3×100 mm, ϕ3×155 mm, ϕ3×210 mm, ϕ3×265 mm, ϕ3×320 mm, and ϕ3×375 mm in order from the one connected to the ink jet head 11 closest to the columnar pipe to the one connected to the ink jet head 16 most distant from the columnar pipe. Internal diameters and lengths of the six sixth conduits 46 are ϕ3×106 mm, ϕ3×160 mm, ϕ3×214 mm, ϕ3×267 mm, ϕ3×321 mm and ϕ3×375 mm in order from the one connected to the ink jet head 11 closest to the columnar pipe to the one connected to the ink jet head 16 most distant from the columnar pipe.

In the second conduit 42, a section above the valve V6 extends upward vertically in the inside of the upstream side tank 25 and the tip thereof is opened to the air layer. In the second conduit 42, a valve V8, which is capable of opening and closing the circulation path, is provided below the branch point. The tip portion of the second conduit 42 located further below the valve V8 is opened to the inside of the downstream side tank 30. The length of the columnar pipe from the branch point to the tip inside the downstream side tank 30 is 143 mm.

Two liquid surface sensors S4 and S5 are provided in the downstream side tank 30. The liquid surface sensors S4 and S5 have a function of detecting whether the liquid surface of the ink in the tank has reached a fourth level and a fifth level set in advance, respectively. The liquid surface sensor S4 is set in a position higher than the liquid surface sensor S5. The downstream side tank 30 has an air layer in the upper part thereof. An openable and closable valve V7 is provided above this air layer. By opening and closing the valve V7 with the control unit 37, it is possible to selectively open or close the liquid surface of the downstream side tank 30 with respect to the atmosphere pressure. An internal pressure of the air layer of the downstream side tank 30 is measured by a pressure sensor 31.

The downstream side tank 30 is formed in, for example, a cylindrical shape having a cross section of 50 $mm^2$ and height of 10 mm. When the liquid surface is at the fifth level, an air layer volume is 5 mL. The third conduit 43, which connects the downstream side tank 30 and the upstream side tank 25, includes the circulating pump 35 and the filter 36. The ink in the downstream side tank 30 is fed back to the upstream side tank 25 via the circulating pump 35 and the filter 36.

The ink is a nonvolatile oil ink having a specific gravity of 0.85 and a viscosity of 10 mPas. The respective ink jet heads 11 to 16 have 636 nozzles having a surface diameter of 27 μm subjected to ink repellent finishing. It is possible to eject ink droplets of 42 pL from the respective nozzles at a frequency of 6240 Hz. An ink flow rate at the time when all the 636 nozzles of one ink jet head continuously eject the ink is 10 mL/min.

A channel resistance between the upstream side ports 11*a* to 16*a* and the downstream side ports 11*b* to 16*b* of the respective ink jet heads is set to $3.85\times10^9$ Pa·s/$m^3$. A ratio of a channel resistance on the upstream side and a channel resistance on the downstream side viewed from the surface of the orifice plate 18 is set to 1:0.96.

Channel resistances of the fifth conduits 45 on the upstream side are $5.03\times10^8$ Pa·s/$m^3$, $7.80\times10^8$ Pa·s/$m^3$, $1.06\times10^9$ Pa·s/$m^3$, $1.33\times10^9$ Pa·s/$m^3$, $1.61\times10^9$ Pa·s/$m^3$, and $1.89\times10^9$ Pa·s/$m^3$, in order from the one connected to the ink jet head 11 closest to the columnar pipe to the one connected to the ink jet head 16 most distant from the columnar pipe.

Channel resistances of the sixth conduits 46 on the downstream side are $5.33\times10^8$ Pa·s/$m^3$, $8.05\times10^8$ Pa·s/$m^3$, $1.08\times10^9$ Pa·s/$m^3$, $1.34\times10^9$ Pa·s/$m^3$, $1.61\times10^9$ Pa·s/$m^3$, and $1.89\times10^9$ Pa·s/$m^3$, in order from the one connected to the ink jet head 11 closest to the columnar pipe to the one connected to the ink jet head 16 most distant from the columnar pipe.

A channel resistance of the first conduit 41 on the upstream side including the valve V5 is $3.77\times10^6$ Pa·s/$m^3$ and a channel resistance from the branch point of the second conduit 42 on the downstream side including the valve V8 to the tip in the inside of the downstream side tank 30 is $4.72\times10^7$ Pa·s/$m^3$.

The liquid surface of the upstream side tank 25 is located higher than the surface of the orifice plates 18 of the ink jet heads 11 to 16 by 12 mm. A head pressure obtained by locating the liquid surface higher is 100 Pa. The liquid surface of the downstream side tank 30 is located lower than the orifice surfaces of the ink jet heads by 120 mm. A head pressure obtained by locating the liquid surface lower is 1 kPa.

Figure 4:
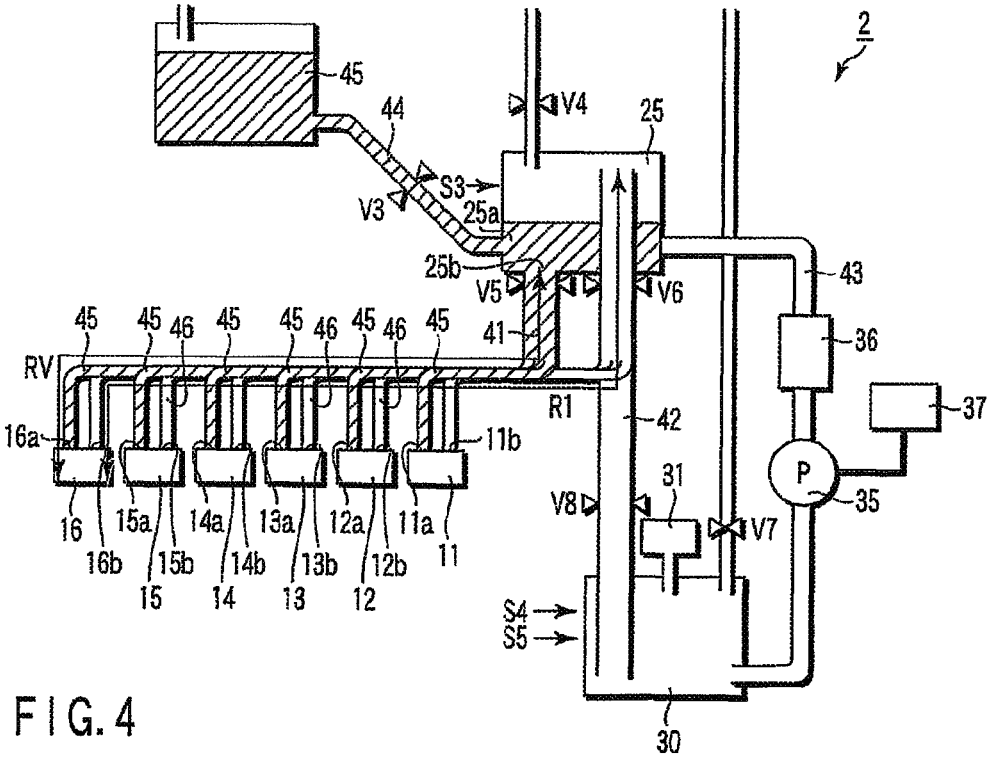
FIG. 4 is a diagram showing an operation of the ink jet recording apparatus according to the second embodiment.
Figure 5:
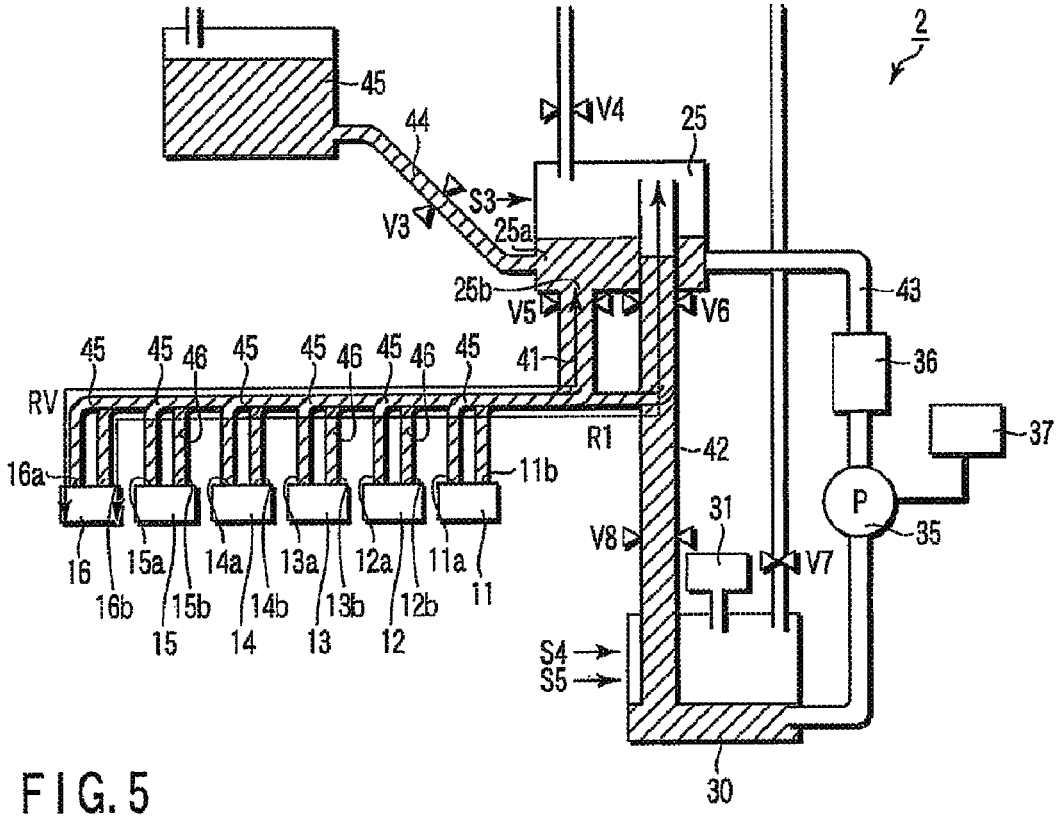
FIG. 5 is a diagram showing the operation of the ink jet recording apparatus according to the second embodiment.

Operations from the initial state to filling of an ink in the ink jet recording apparatus will be explained. In FIGS. 3 to 7, portions in which the ink is filled are indicated by hatching. In the initial state shown in FIG. 3, the ink is stored in the supply tank 45. When the valves V4, V5, V6, and V8 are opened and then the valve V3 is opened from this state, as shown in FIG. 4, the ink flows down from the upper tank to the lower tank. While the ink flows down, the valve V7 is closed. As shown in FIG. 5, the ink flows down from the supply tank 45 to the downstream side tank 30 through the fourth conduit 44, the upstream side tank 25, the first conduit 41, the ink jet heads 11 to 16, and the second conduit 42. While the liquid surface sensor S3 detects that the liquid surface of the upstream side tank 25 exceeds the third level, the valve V3 is closed to adjust the liquid surface.

When the ink in the second conduit 42 has reached the valve V6, the valve V6 is closed and the valve V7 is opened. It is possible to judge whether the ink has reached the valve V6 according to time from the start of the supply. It is also possible to judge whether the ink has reached the valve V6 according to a value of a pressure gauge 31 (a pressure detector) of the downstream side tank 30. When a reading of the pressure gauge 31 coincides with a potential pressure of the ink at the height from the downstream side tank 30 to the valve V6, it is possible to judge that the ink has nearly reached the position of the valve V6. In this embodiment, even if the ink in the second conduit 42 overflows to the air layer of the upstream side tank 25 passing the valve V6, no problem is caused in particular. High accuracy is not required for timing.

Figure 6:
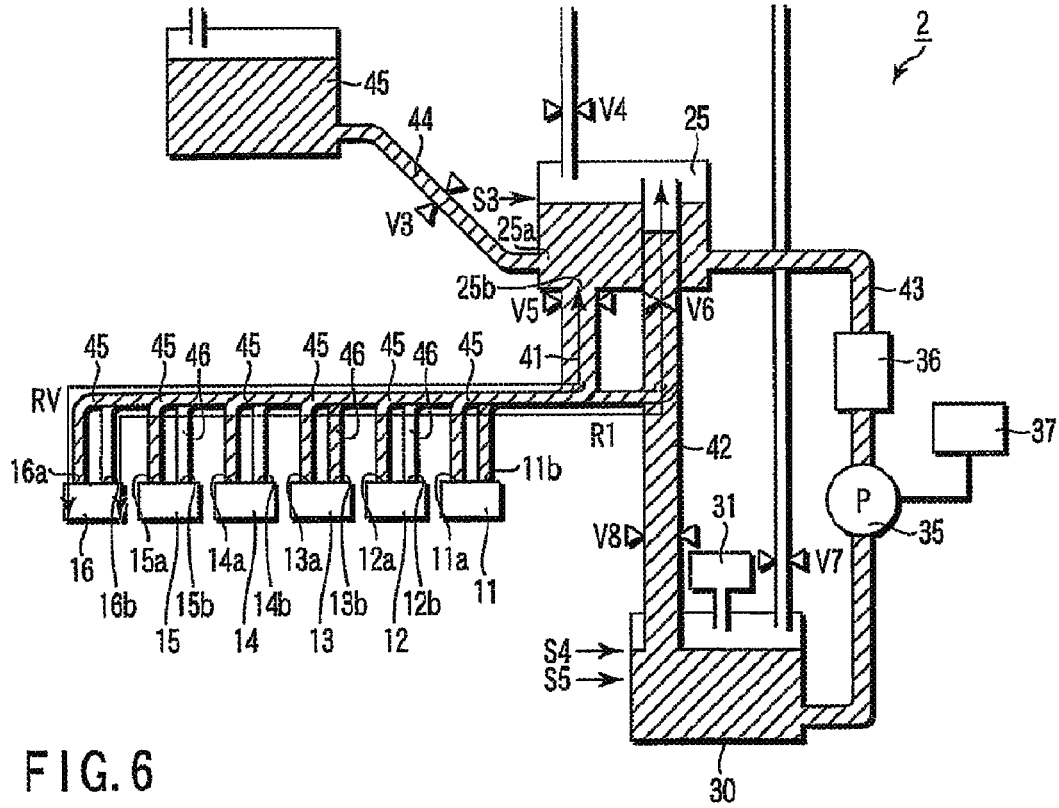
FIG. 6 is a diagram showing the operation of the ink jet recording apparatus according to the second embodiment.

The circulating pump 35 is set to operate when the liquid surface of the downstream side tank 30 exceeds the fourth level. As shown in FIG. 6, when the ink accumulates in the downstream side tank 30 and exceeds the fourth level, the conditions set are satisfied. Thus, the circulating pump 35 operates. The circulating pump 35 pumps up the ink in the downstream side tank 30 to the upstream side tank 25 via the filter 36 and the third conduit 43 forming the feedback channel. In this case, the ink in the upstream side tank 25 may be slightly higher than the third level. However, an influence on a pressure distribution of the circulating system is small and negligible. This state is a low-speed circulation state in which the ink circulates slowly.

During the operation, first, a positive pressure is given to the respective nozzles 17 of the ink jet heads 11 to 16. A value of the positive pressure decreases as the ink is filled on the downstream side. A maximum value of the positive pressure given is about 100 Pa. To prevent the ink from dripping because of the positive pressure, the nozzles 17 of the ink jet heads 11 to 16 only have to be closed by not-shown caps during the operation. Besides, as explained later, by keeping a condition for maintaining a proper meniscus, it is possible to prevent the ink from dripping from the nozzles 17 of the ink jet heads 11 to 16 even if the caps are not provided.

A circulation flow rate in this case is calculated as 62 mL/min in total of the six ink jet heads 11 to 16. Circulation flow rates of the respective ink jet heads 11 to 16 are 13 mL/min, 12 mL/min, 11 mL/min, 10 mL/min, 9 mL/min, and 8 mL/min in order from the ink jet head 11 closest to the columnar pipe. Pressures near the nozzles 17 are substantially equal at −434 Pa in all the ink jet heads 11 to 16. Printing is also possible in this state.

A procedure for increasing circulation speed to 180 mL/min in total of the six ink jet heads 11 to 16 in order to enjoy the advantages of the ink circulating system will be explained. As shown in FIG. 7, the valve V7 is closed, the downstream side tank 30 is closed, and the circulating pump 35 is caused to operate until the pressure gauge 31 indicates −2110 Pa. The circulating pump 35 is set to operate only while the pressure gauge 31 indicates a pressure below −2110 Pa. In this case, although the air layer in the downstream side tank 30 is expanded by decompression, the liquid surface slightly lowers by about 0.2 mm because of the decompression. A change in a potential pressure due to this change in the liquid surface is sufficiently low and negligible. It can be said that it is more desirable to manage the conditions in this embodiment by directly measuring a pressure than managing the conditions according to the liquid surface as in the first embodiment. It goes without saying that, when it is possible to accurately detect the liquid surface, the conditions may be managed according to the liquid surface as in the first embodiment. If a shape of the downstream side tank 30 is different and, for example, if a volume of the air layer is larger, the liquid surface management may be more advantageous than the pressure management. Thus, any one of the managements may be used. This state is a high-speed circulation state in which the ink circulates at 180 mL/min.

Circulation flow rates of the ink jet heads 11 to 16 are 38 mL/min, 34 mL/min, 31 mL/min, 28 mL/min, 26 mL/min, and 24 mL/min in order from the ink jet head 11 closest to the columnar pipe. Pressures near the nozzles 17 are substantially equal at −1.46 kPa in all the ink jet heads 11 to 16.

In the above explanation, the ink jet heads 11 to 16 do not eject the ink or eject the ink only a little. However, when the ink is ejected, since a flow rate on the upstream side increase and a flow rate on the downstream side decreases, pressures near the nozzles 17 shift further to the negative pressure side. When the ink jet heads 11 to 16 eject a maximum quantity of ink, the pressures near the nozzles 17 (an average excluding a high-frequency component generated by the actuator for an ink ejection operation) shift to the negative pressure side most. Pressures near the nozzles 17 of the ink jet heads 11 to 16 in that case are calculated as −1.68 kPa, −1.7 kPa, −1.72 kPa, −1.73 kPa, −1.77 kPa, and −1.79 kPa in order from the ink jet head 11 closest to the columnar pipe. All the pressures in these nozzle positions are within a range of proper values.

The liquid surface sensor S5 is not always necessary for the operations described above. However, it is possible to use the sensor for abnormality detection. The liquid surface sensor S5 is set, for example, 1 mm below the position of the liquid surface sensor S4. In the normal operation, the liquid surface should not be lower than the liquid surface sensor 55 during circulation. Thus, if the liquid surface of the downstream side tank 30 becomes lower than the height of the liquid surface sensor S5, it is possible to detect, as abnormality, ink leakage somewhere in a passage of the ink extending from the upstream side tank 25 to the downstream side tank 30 through the ink jet heads.

Conditions for prevention of ink drop will be explained. In general, in a circulation supply system, energy per a unit volume of the ink supply source on the upstream side viewed from the height of the surface of the orifice plate 18 (a sum of a static pressure and a potential pressure on the liquid surface of the upstream side tank 25) is usually larger than a pressure P1 suitable for ink ejection of an ink jet head by an upstream side channel resistance×a circulation flow rate.

Therefore, even if the meniscus is in a state of a concave shape shown in FIG. 8A during circulation, when the circulation stops because of some reason, a negative pressure of the meniscus decreases and changes to a positive pressure. The meniscus projects from the tip of the nozzle and swells as shown in FIG. 8B.

Besides before the start of circulation at the beginning of warm-up, the meniscus is in such a state, for example, when electric power is saved in the standby state and circulation is stopped for emergency stop. A degree of the swell of the meniscus depends on an ink pressure near the nozzle. In the circulation supply system in this embodiment, the degree of the swell of the meniscus depends on a head difference between the liquid surface of the upstream side tank 25 and the surface of the orifice plate 18.

When the pressure near the nozzle is high, the meniscus swells more and changes from the state in FIG. 8B to a state in FIG. 8C. When the pressure near the nozzle reaches P2, it is impossible to keep an ink droplet on the tip surface of the nozzle 17. The ink 20 drops or spreads to the orifice plate 18 passing the tip of the nozzle 17 and drops.

The drop of the ink at the time of standby or the like is not preferable because the ink is consumed excessively and a section around the nozzle is stained. Therefore, it is advisable to set the energy per a unit volume of the ink supply source on the upstream side viewed from the height of the surface of the orifice plate 18 (the sum of a static pressure and a potential pressure on the liquid surface of the upstream side tank 25) smaller than P2. For example, in the second embodiment, since the static pressure on the liquid surface of the upstream side tank 25 is 0 (the atmospheric pressure) and the potential pressure thereof is 100 Pa, the energy per a unit volume of the ink supply source on the upstream side viewed from the height of the surface of the orifice plate 18 is 100 Pa. On the other hand, P2 is equal to or higher than about 2 kPa in actual measurement. Therefore, if the surface of the orifice plate 18 is cleaned as described later, the drop of the ink is prevented.

To lower a reduced pressure on the surface of the orifice plate 18 of the ink supply source on the upstream side while maintaining the meniscus pressure Pn at the time of circulation, the upstream side channel resistance should be reduced. For this purpose, the ink supply source on the upstream side should be set as close as the ink jet head 11. A structure according to the second embodiment is set in this way.

When there is no adhesion of the ink near the nozzle 17 and the nozzle 17 is maintained clean, the ink 20 does not overflow the nozzle 17 in the state in FIG. 8C and drop. Therefore, the drop of the ink is prevented by maintaining the surface of the nozzle 17 clean or drying the ink jet head 11 prior to an ink filling operation or the like. Consequently, the ink is prevented from dropping from the nozzle 17 and a static pressure as high as P2 is allowed.

Figure 9A:
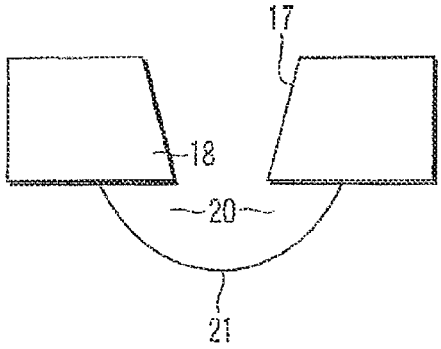
FIG. 9A is a sectional view showing an ink drop condition around the nozzle according to the second embodiment.
Figure 9B:
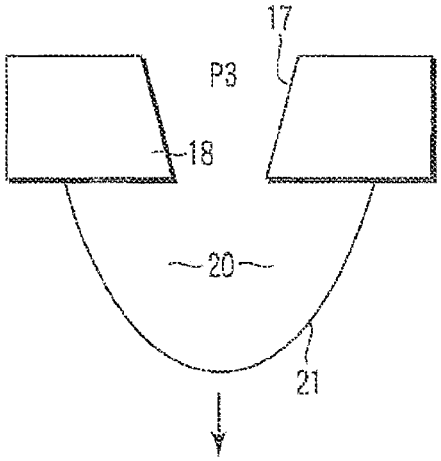
FIG. 9B is a sectional view showing the ink drop condition around the nozzle according to the second embodiment.

On the other hand, even if an ink pressure near the nozzle 17 is lower than P2, if a meniscus 21 in FIG. 8B formed in a convex shape by wipe or the like is broken, the ink spreads over the orifice plate 18 as shown in FIG. 9A and drops at a pressure P3 lower than P2 as shown in FIG. 9B.

Figure 10A:
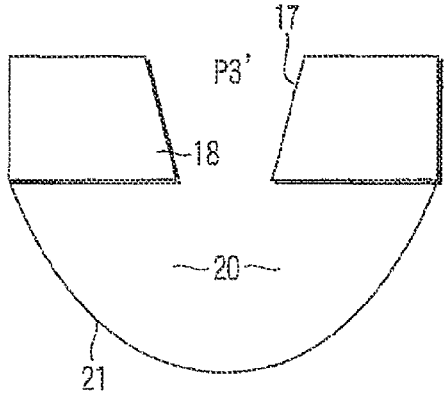
FIG. 10A is a sectional view showing an ink drop condition around the nozzle according to the second embodiment.
Figure 10B:
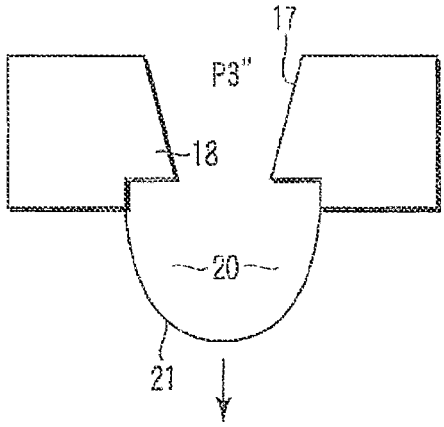
FIG. 10B is a sectional view showing the ink drop condition around the nozzle according to the second embodiment.

As shown in FIG. 10A, when a distance from the nozzle 17 to the surface of the orifice plate 18 is relatively small, the ink 20 invades the side of a nozzle plate at a pressure P3'. As shown in FIG. 10B, when the orifice plate 18 has a concave section larger than the hole of the nozzle 17 in the surface thereof, the ink flows out to the uppermost step of the orifice plate 18, on which the ink should not usually adhere, at a pressure P3" or more. The flow-out of the ink is not preferable because the section around the nozzle is stained. Therefore, it is more desirable to keep a reduced pressure on the nozzle surface of the ink supply source on the upstream side at a pressure equal to or lower than P3, P3', or P3". Magnitudes of P1, P2, and P3 depend on a shape of the section around the nozzle, an angle of contact between a nozzle material and the ink, and a surface tension of the ink and obtained by a calculation or an experiment. A relation among the pressures is P2>P3">P3 and P3'>0>P1.

In this embodiment, effects same as those of the ink jet recording apparatus 1 according to the first embodiment are obtained. In the ink jet recording apparatus 2 according to this embodiment, it is also possible to cope with plural ink jet heads.

Third Embodiment

An ink jet recording apparatus according to a third embodiment of the invention will be explained with reference to FIGS. 11 to 16. Explanations of components same as those in the first embodiment or the second embodiment are omitted. In the figures, components are schematically shown by enlarging, reducing, or simplifying the components as appropriate.

Figure 11:
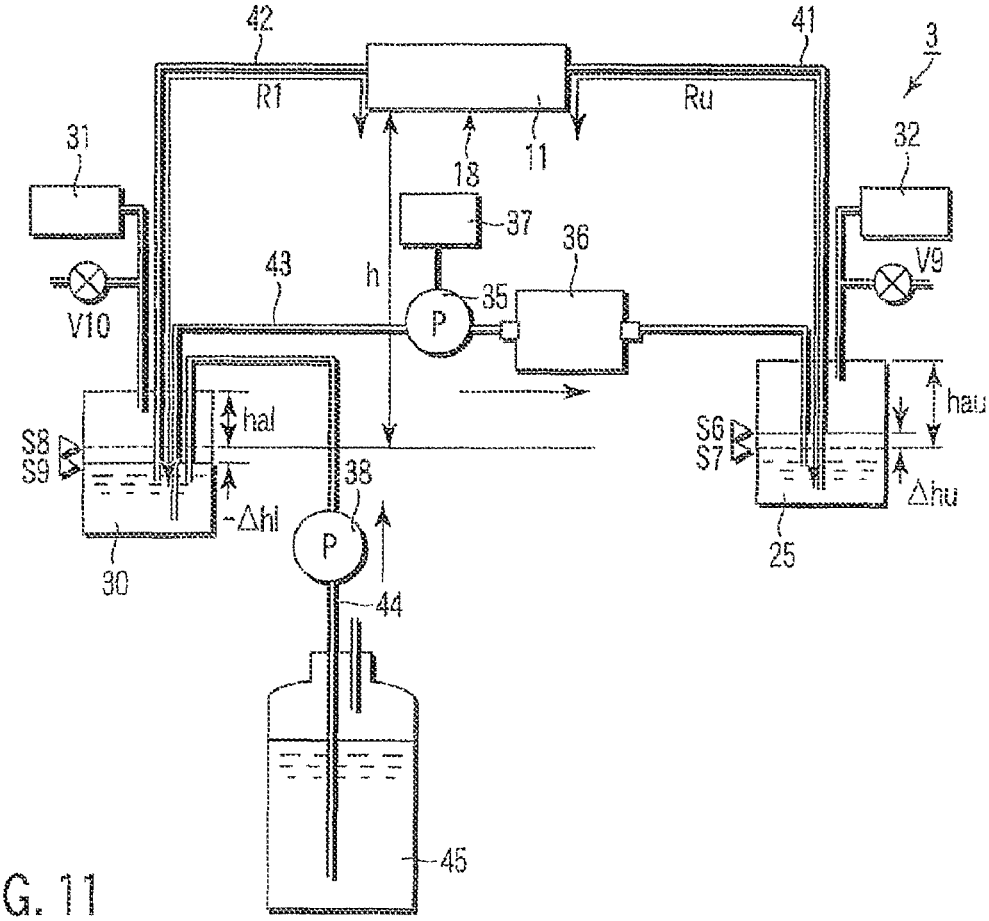
FIG. 11 is a diagram schematically showing an overall structure of an ink jet recording apparatus according to a third embodiment of the invention.

The ink jet recording apparatus 3 shown in FIG. 11 includes the ink jet head 11, the upstream side tank 25 that stores an ink supplied to the ink jet head 11, the downstream side tank 30 that stores the ink, the supply tank 45 that supplies the ink to the downstream side tank 30, the conduits 41 to 44 that form a circulation path for the ink, and the circulating pump 35 serving as an ink sending mechanism that circulates the ink.

The ink jet head 11 has the same structure as the ink jet head 11 according to the first embodiment.

Both the upstream side tank 25 and the downstream side tank 30 are arranged lower than the ink jet head 11. The upstream side tank 25 is connected to the upstream port 11*a* of the ink jet head 11 via the first conduit 41. The downstream side tank 30 is connected to the downstream side port 11*b* of the ink jet head 11 via the second conduit 42. The upstream side tank 25 and the downstream side tank 30 are connected via the third conduit 43. The third conduit 43 includes the circulating pump 35 having an ink sending function and the filter 36. The inside of the downstream side tank 30 is connected to the supply tank 45, which stores the ink supplied to the downstream side tank 30, via the fourth conduit 44. The supply pump 38 having an ink sending function is provided in the middle of the fourth conduit 44.

The supply tank 45 may be a replaceable cartridge or may be a tank in which the ink is poured from above. An internal pressure of the supply tank 45 is opened to the atmosphere. The ink in the supply tank 45 is poured into the downstream side tank 30 through the fourth conduit 44 via the supply pump 38.

The upstream side tank 25 is formed in a columnar shape without a change in a cross section. Two liquid surface sensors S6 and S7 are provided in the upstream side tank 25. The liquid surface sensors S6 and S7 have a function of detecting whether the liquid surface of the ink in the tank has reached a sixth level and a seventh level set in advance, respectively. The height of the air layer above the seventh level is set as hau. The air layer of the upstream side tank 25 is connected to the atmosphere via an openable and closable valve V9. By opening and closing the valve V9 with the control unit 37, it is possible to selectively open or close the liquid surface of the upstream side tank 25 with respect to the atmosphere pressure. Moreover, a pressure gauge 32 that is capable of measuring a pressure in the air layer inside the upstream side tank 25 is provided in the upstream side tank 25.

The downstream side tank 30 is formed in a columnar shape without a change in a cross section. Two liquid surface sensors S8 and S9 are provided in the downstream side tank 30. The liquid surface sensors S8 and S9 have a function of detecting whether the liquid surface of the ink in the tank has reached an eighth level and a ninth level set in advance, respectively. The height of the air layer above the liquid surface sensor S8 is set as hal. The air layer of the downstream side tank 30 is connected to the atmosphere via an openable and closable valve V10. By opening and closing the valve V10 with the control unit 37, it is possible to selectively open or close the liquid surface of the downstream side tank 30 with respect to the atmosphere pressure. Moreover, the pressure gauge 31 that is capable of measuring a pressure in the air layer inside the downstream side tank 30 is provided in the downstream side tank 30.

The plural tanks 25, 30, and 45, the head 11, and the conduits 41 to 44 constitute a circulation system that can circulate the ink.

The seventh level and the eighth level are at the same height and set below the nozzle by height h. The ninth level is set blow the eighth level by −Δhl (Δhl is a negative value). The sixth level is set above the seventh level by Δhu.

Internal volumes of a section connected to the valve V9 and the pressure gauge 32 and a section connected to the valve V10 and the pressure gauge 31 are sufficiently small. If there is a change in a cross section in the upper parts of the upstream side tank 25 and the downstream side tank 30 or the internal volumes of the section connected to the valve V9 and the pressure gauge 32 and the section connected to the valve V10 and the pressure gauge 31 are ineligible, hau and hal only have to be corrected by replacing the tanks with tanks of a columnar shape having the same volume and without a change in a cross section.

For example, like a tube pump, both the circulating pump 35 and the supply pump 38 close when stopped. The same function may be realized by connecting a diaphragm pump and a check valve in series. The circulating pump 35 and the supply pump 38 are controlled by, for example, ON/OFF control or speed control.

A specific gravity of the ink in this embodiment is 0.85 and h=120 mm. A channel resistance Ru from the upstream side tank 25 to the surface of the orifice plate 18 is $Ru=4\times10^9$ $Pa\cdot s/m^3$ and a channel resistance R1 from the surface of the orifice plate 18 to the downstream side tank 30 is Rl=$4\times10^9$ Pa·s/$m^3$. hau=51 mm, hal=49 mm, Δhu=1 mm, and Δhl=−1 mm. A cross section of the upstream side tank 25 and a cross section of the downstream tank 30 are the same. The atmospheric pressure is 101 kPa and a gravitational acceleration is 9.8 m/$s^2$.

Operations from the initial state to filling of an ink in the ink jet recording apparatus 3 will be explained. In the initial state, the ink is stored in the supply tank 45. When the valve V10 is opened and the supply pump 38 is caused to operate, the ink is fed to the downstream side tank 30 and stored therein. When the valve V9 is opened and the circulating pump 35 is caused to operate, the ink in the downstream side tank 30 is flows into the upstream side tank 25 via the filter 36. In this case, it is possible to adjust a level of the ink by driving the circulating pump 35 and the supply pump 38 as appropriate while monitoring the liquid surface sensors S6, 57, 58, and S9. The liquid surface of the upstream side tank 25 is adjusted to the seventh level and the liquid surface of the downstream side tank 30 is adjusted to the eighth level. In this state, the height of the liquid surface of the upstream side tank 25 and the height of the liquid surface of the downstream side tank 30 coincide with each other.

The valve V9 and the valve V10 are closed to slowly drive the circulating pump 35. According to the driving of the circulating pump 35, the ink flows through the first conduit 41, the ink jet head 11, and the second conduit 42 in this order to be filled in the circulating system.

The circulating pump 35 is stopped in this state. When a circulating flow stops, the valve V9 and the valve V10 are opened. Since a total quantity of the ink is reduced by a quantity filled in the circulating system including the first conduit 41, the ink jet head 11, and the second conduit 42, the supply pump 38 and the circulating pump 35 are driven as appropriate again while monitoring the liquid surface sensors S6, S7, S8, and S9 to adjust the respective liquid surfaces to the seventh level and the eighth level.

In this state, the circulation is stopped and the liquid surface of the ink jet head 11 is located above the surface opened to the atmosphere by h=120 mm. Therefore, a negative pressure of −ρgh=−1 kPa is applied to the neighborhood of the nozzle of the ink jet head 11. This negative pressure is an appropriate value as an ink pressure at the time when the ink is not ejected.

An operation for circulating the ink will be explained. In a state in which the ink is filled, the valves V9 and V10 are closed and the circulating pump 35 is driven until the liquid surface of the upstream side tank 25 reaches the position of the liquid surface sensor 56. Thereafter, the circulating pump 35 is controlled to maintain the position of the liquid surface sensor S6. In this case, since the air in the upstream side tank 25 is compressed, the pressure therein rises. Since the air in the downstream side tank 30 expands, the pressure therein falls. Since the cross section of the upstream side tank 25 is uniform, a volume of the air layer is proportional to the height of the air layer. Therefore, a gauge pressure Pau in the air layer of the upstream side tank 25 is Pau=Δhu/(hau−Δhu)×101 kPa=1/(51−1)×101 kPa=2.02 kPa. In this case, a quantity of the ink in the upstream side tank 25 decreases by a volume obtained by multiplying Δhu by the cross section of the upstream side tank 25. However, since a total quantity of the ink in the circulation path does not change if the pump 38 is stopped, a quantity of the ink in the downstream side tank 30 increases by the same volume. Since the cross sections of the upstream side tank 25 and the downstream side tank 30 are the same, Δhl=−Δhu=−1 mm. Since the cross section of the downstream side tank 30 is uniform, a volume of the air layer is proportional to the height of the air layer. Therefore, a gauge pressure Pal of the air layer of the downstream side tank 30 is Pal=Δhl/(hal−Δhl)×101 kPa=−1/(49+1)×101 kPa=2.02 kPa.

Since the liquid surface of the upstream side tank 25 rises 1 mm and the liquid surface of the downstream side tank 30 falls 1 mm, a potential pressure of 17 Pa acts in a circulation direction. Since a differential pressure between the upstream side tank 25 and the downstream side tank 30 is 4.04 kPa, a circulation flow rate is (4040+17 Pa)/$8\times10^9$ Pa·s/$m^3\times100^3\times60$=30 4 mL/min. A pressure Pn near the nozzle 17 is obtained by dividing Pau−ρg(h−Δhu) and Pal−ρg(h−Δhl) by Ru and Rl. Since Ru=Rl and Δhu=−Δhl, Pn=−ρgh=−1 kPa. This is identical with that before the start of the circulation and is within a range of proper values.

When the ink jet head 11 ejects the ink, a flow rate on the upstream side increases and a flow rate on the downstream side decreases. Thus, Pn shakes further to a negative pressure side than −1 kPa. It is possible to consider that this pressure change is equivalent to a pressure loss at the time when an upstream side channel resistance and a downstream side channel resistance are arranged in parallel and the ink of an ejection flow rate is fed. When a maximum ejection quantity Qi of the ink jet head 11 is set to 10 mL/min as in the second embodiment, a pressure loss Ploss is Ploss=Ru*Rs/(Ru+Rs)*Qi=$2\times10^9$ Pa·s/$m^3\times10$ mL/min×1($100^3\times60$)=333 Pa. Thus, a pressure near the nozzle 17 (an average excluding a high-frequency component generated by an actuator for an ink ejection operation) fall to about −1.33 kPa when a maximum quantity of the ink is ejected. This value is within the range of proper values.

When a flow rate is higher and Pn at the time of ejection excessively shifts to the negative pressure side, Ru and Rl should be reduced. For example, it is possible to reduce Ru and Rl by increasing or decreasing diameters of the conduits. When the ink jet head 11 continues the ejection, since a total quantity of the ink in the circulating system decreases, the supply pump 38 is driven to fill the ink. For example, when the liquid surface of the downstream side tank 30 falls below the ninth level, it is advisable to drive the supply pump 38 to supply the ink.

In this embodiment, the liquid surface sensors S6, S7, S8, and 59 need to correctly detect a level difference of +/−1 mm. However, when it is desired to ease the requirement of accuracy of the liquid surface sensors S6, S7, 58, and S9, hau and hal only have to be set higher than those in this embodiment while maintaining a ratio of hau, hal, Δhu, and Δhl.

Figure 12:
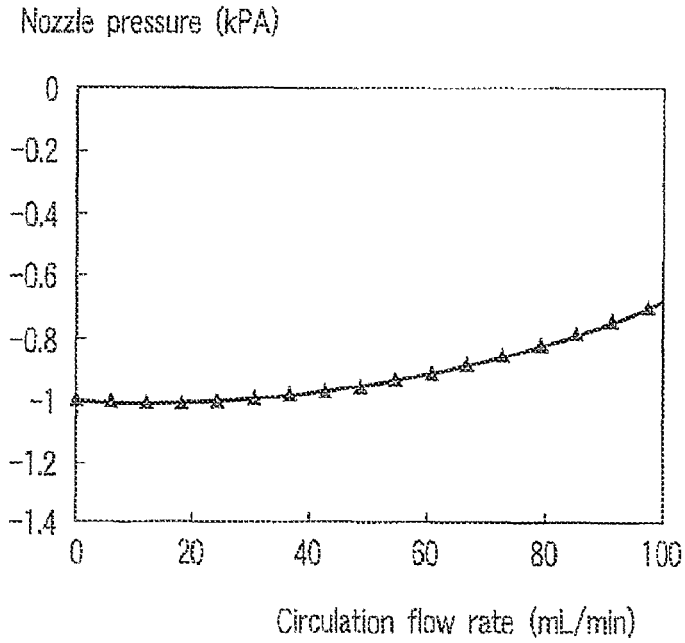
FIG. 12 is a graph showing a relation between a circulation flow rate and a nozzle pressure of the ink jet recording apparatus according to the third embodiment.
Figure 13:
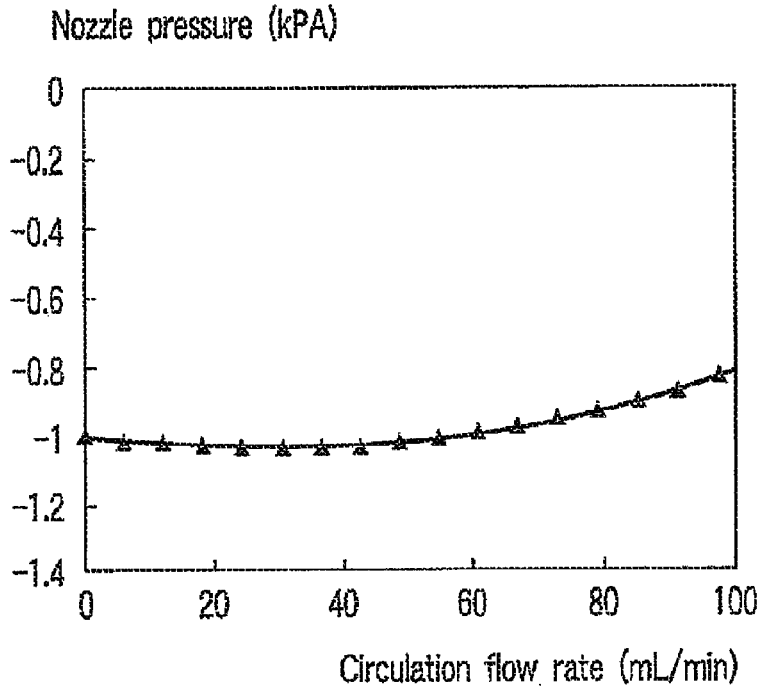
FIG. 13 is a graph showing a relation between a circulation flow rate and a nozzle pressure of the ink jet recording apparatus according to the third embodiment.

In the following explanation, in the ink jet recording apparatus 3, the liquid surface sensor 56 is lifted and the liquid surface sensor S9 is lowered to change a circulation flow rate to 0-100 mL/min. When the liquid surface sensor S6 is lifted and the liquid surface sensor S9 is lowered by the same degree, a pressure in the upstream side tank rises and a pressure in the downstream side tank falls. As a result, the circulation flow rate increases. While the height of the liquid surface sensor S6 is changed, when the height of the liquid surface sensor 59 is shifted in the opposite direction by the same degree and the circulation flow rate is changed to 0-100 mL/min, a pressure near the nozzle 17 changes as shown in FIG. 12 with respect to the circulation flow rate. In other words, when the circulation flow rate is higher than 30 mL, the pressure near the nozzle 17 shifts to the positive pressure side. When a target circulation flow rate is higher than 30 mL, a difference between hau and hal, i.e., a difference between the heights of the air layers of the upstream side ink tank and the downstream side ink tank before the start of the circulation should be increased. For example, when hau=52 mm and hal=48 mm, a relation between the circulation flow rate and the pressure near the nozzle 17 is flat in a wider area as shown in FIG. 13.

Figure 14:
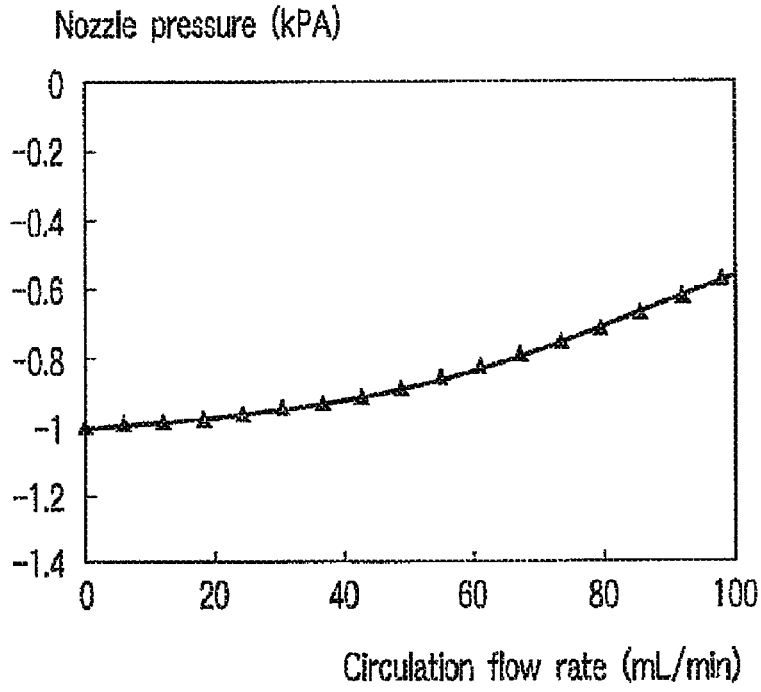
FIG. 14 is a graph showing a relation between a circulation flow rate and a nozzle pressure of the ink jet recording apparatus according to the third embodiment.
Figure 15:
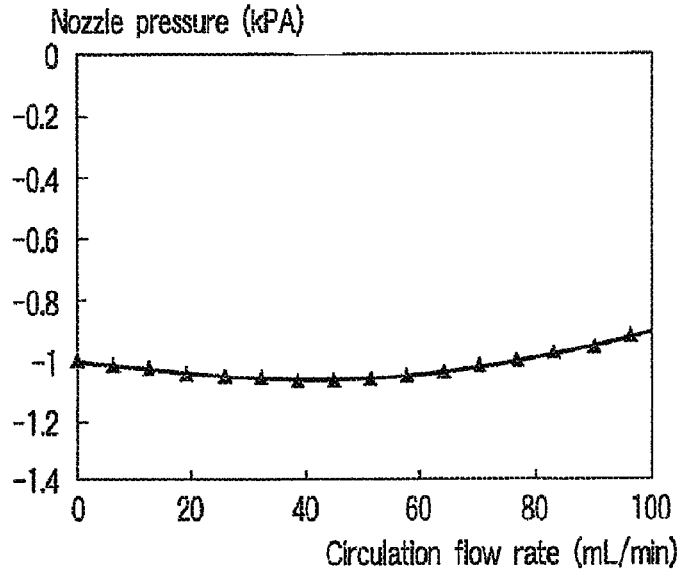
FIG. 15 is a diagram showing a relation between a circulation flow rate and a nozzle pressure of the ink jet recording apparatus according to the third embodiment.

Moreover, instead of changing the heights of the air layers of the upstream side tank 25 and the downstream side tank 30, the cross sections of the upstream side tank 25 and the downstream side tank 30 may be changed. For example, when hau=50 mm and hal=50 mm, if a ratio of the cross sections of the upstream side tank 25 and the downstream side tank 30 is 1:1, a relation between the circulation flow rate and the pressure near the nozzle 17 is as shown in FIG. 14. Thus, as the flow rate increases, the pressure near the nozzle 17 increases. Thus, if a ratio of the cross sections of the upstream side tank 25 and the downstream side tank 30 is set as 1:0.9, a relation between the circulation flow rate and the pressure near the nozzle 17 is as shown in FIG. 15 and is flat in a wider area.

In the example explained above, the meniscus pressure near the nozzle 17 changes in a concave shape with respect to the circulation flow rate. However, if a potential head of the liquid surface of the downstream side tank 30 falls by a great degree when the circulation flow rate increases by, for example, forming the downstream side tank 30 in a conical shape having a smaller cross section in the lower part thereof, it is possible to set the pressure near the nozzle 17 not to change even when the circulation flow rate changes.

An adjusting method for not changing the pressure near the nozzle 17 before and after the operation of the circulation pump 35 will be explained. Here, a volume of the air layer in the initial state of the upstream side tank 25 is Vu, a volume of the air layer in the initial state of the downstream side tank 30 is V1, a volume of the ink moving from the downstream side tank 30 to the upstream side tank 25 is ΔV, the height of rise from the initial state of the liquid surface of the upstream side tank 25 is Δhu, the height of fall from the initial state of the liquid surface of the downstream side tank 30 is −Δhl, a channel resistance from the upstream side tank 25 to the surface of the orifice plate 18 is Ru, a channel resistance from the downstream side tank 30 to the surface of the orifice plate 18 is Rl, a specific gravity of the ink is ρ, a gravitational acceleration is g, the atmospheric pressure is Patm, an increased air pressure in the upstream side tank 25 is Pu (a gauge pressure), a decreased air pressure in the downstream side tank 30 is Pl (a gauge pressure), an initial liquid surface height of the downstream side tank 30 with respect to the height of the surface of the orifice plate 18 is h, and a pressure near the nozzle 17 is Pn.

In the initial state, Pn=ρgh. When the circulating pump 35 is caused to operate and the ink of Δv moves, Pu=Δv/(Vu−ΔV)Patm and PL=−ΔV/(Vl+ΔV)Patm. A potential pressure on the liquid surface of the upstream side tank 25 is ρg(h+Δhu) and a potential pressure on the liquid surface of the downstream side tank 30 is ρg(h+Δhl).

When it is assumed that Ru=Rl to simplify a calculation, Pn=(½){Pu+ρg(h+Δhu)+PL+ρg(h+Δh1)}=ρgh+(½)(Pu+Pl+ρpghΔhu+ρgΔhl)=ρgh+(½){ΔV(V1−Vu)+2ΔV²}/{(Vu−ΔV)(Vl+ΔV)Patm+(ρg/2)(Δhu+Δhl).

To prevent the pressure near the nozzle 17 from changing before and after the operation of the circulating pump 35, {ΔV(Vl−Vu)+2ΔV²}/{(Vu−ΔV)(Vl+ΔV)}Patm=ρg(Δhl+Δhu)−Δhl=(Patm/ρg){ΔV(Vl−Vu)+2ΔV²}/{(Vu−ΔV)(Vl+ΔV)}+Δhu.

If the upstream side tank 25 has a columnar pipe shape having an area Su, ΔV=SuΔhu and −Δhu=ΔV/Su. Thus, −Δhl=Patm/ρg{ΔV(Vl−Vu)+2ΔV²}/{(Vu−ΔV)(Vl+ΔV)}+(ΔV/Su) (Equation 1).

Figure 16:
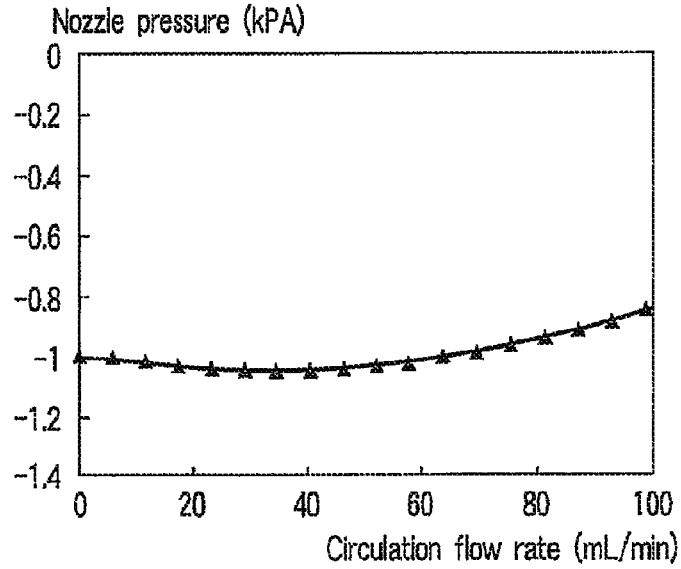
FIG. 16 is a diagram showing a relation between a circulation flow rate and a nozzle pressure of the ink jet recording apparatus according to the third embodiment.

When Vu=Vl=V, −Δhl=2(Patm/ρg)(ΔV²/V²−ΔV²)+ΔV/Su (Equation 2). Therefore, when the liquid surface of the downstream side tank 30 falls below Δhl, the cross section of the downstream side tank 30 only has to be adjusted such that Equation 1 or Equation 2 holds to have a volume change of ΔV It is also possible to adjust a channel resistance ratio of the upstream side channel and the downstream side channel instead of the heights of the air layers or the cross section ratio of the upstream side tank 25 and the downstream side tank 30 to adjust a pressure change characteristic of the pressure near the nozzle 17 with respect to a flow rate. For example, hau and hal are set as hau=50 mm and hal=50 mm and channel resistances are set as Ru=$4.4\times10^9$ Pa·s/m³ and Rl=$4.0\times10^9$ Pa·s/m³ by extending the upstream side channel while keeping the cross section ratio of the upstream side tank 25 and the downstream side tank 30 at 1:1. Then, a relation between the circulation flow rate and the pressure near the nozzle 17 is as shown in FIG. 16 and is flat in an area wider than that in FIG. 14.

In this embodiment, effects same as those of the ink jet recording apparatus 1 according to the first embodiment are obtained. Moreover, it is possible to lower the pressure in the downstream side tank not only by closing the downstream side tank and raise the pressure in the upstream side tank but also by making it possible to close the upstream side tank. This makes it possible to improve a degree of freedom of the arrangement of the tanks 25, 30, and 50 and the ink jet head 11.

The invention is not limited to the embodiments described above. It goes without saying that, in carrying out the invention, elements of the invention such as specific shapes of the components may be changed in various ways without departing from the spirit of the invention. For example, in the embodiments, the circulating pump 35 is controlled according to detection of the liquid surface sensors. However, the circulating pump 35 may be caused to operate at a constant flow rate. In the embodiments, the supply of the ink is controlled according to detection of the liquid surface sensor 3. However, the supply of the ink may be controlled such that a weight of the downstream side tank 30 is fixed.

The supply of the ink from the supply tank 45 may be performed by the supply pump 38 or may be controlled by a valve using a natural supply flow rate determined by a liquid surface height of the supply tank 45, a negative pressure in the downstream side tank 30, and a channel resistance from the user tank to the downstream side tank 30.

In the embodiments, the supply pump 38 is controlled according to detection by the liquid surface sensors. However, it is also possible that the supply pump 38 is made rotatable regularly and reversely, a value obtained dividing values of the pressure gauge 31 and the pressure gauge 32 by Ru and Rl is calculated, when the value is smaller than 0, the supply pump 38 is rotated regularly to supply the ink, and, when the value is larger than 0, the supply pump 38 is rotated reversely to feed the ink back to the supply tank 45. Such a control may be performed to set the calculation value to 0. By performing the control, even when hau and hal change, since an influence on the pressure near the nozzle is only by a degree of a potential pressure difference. Thus, there is an advantage that it is unnecessary to too strictly adjust hau and hal.

In this way, when the supply pump 38 are capable of rotating regularly and reversely, the upstream side tank 25 and the downstream side tank 30 do not always have to be lower than the ink jet head. It is also possible that the upstream side tank 25 and the downstream side tank 30 are located above the ink jet head and the valves are closed to rotate the supply pump 38 reversely and generate a negative pressure. For example, the liquid surfaces of the upstream side tank 25 and the downstream side tank 30 are set in a position 30 mm above the nozzle and hau and hal are set as hau=hal=50 mm. In this case, since the valve 1 and the valve 2 are opened, it is likely that the ink drops from the nozzle. However, the drop of the ink is prevented by the method explained in the second embodiment. Subsequently, the valve 1 and the valve 2 are closed. According to a value obtained by dividing readings of the pressure gauge 1 and the pressure gauge 2 by Ru and R1, i.e., in this embodiment, an average Pave of the readings of the pressure gauge 31 and the pressure gauge 32 because Ru=Rl, when Pave is further on the positive pressure side than −1 kPa, the supply pump 38 is rotated reversely to feed the ink back to the supply tank 45 and, when Pave is further on the negative pressure side than −1 kPa, the supply pump 38 is rotated regularly to supply the ink. Then, a nozzle pressure is −1 kPa. In this case, the liquid surfaces of the upstream side tank 25 and the downstream side tank 30 are lower than those in the beginning. Subsequently, when the circulating pump is driven at 30.4 mL/min, the liquid surface of the upstream side tank 25 rises and the liquid surface of the downstream side tank 30 falls. The liquid surface of the upstream side tank 25 and the liquid surface of the downstream side tank 30 in this state are Δhu=0.38 mm and Δhl=−1.67 mm with a point when the valves are closed, i.e., the position 30 mm above the nozzle as a reference. This height change in the liquid surfaces is negligibly small as an influence on the pressure near the nozzle. Even in this period, it is possible to maintain the pressure near the nozzle substantially at −1 kPa from a period before the circulation start until a period during circulation if the supply pump 38 is controlled to rotate regularly and reversely as appropriate such that Pave=−1 kPa.

It is possible to remove redundant sensors not in use. However, the sensors may be used for abnormality detection without being removed. It is possible to learn abnormality from a relation between a liquid surface sensor and a pump flow rate. For example, when the circulating pump 35 is driven at a constant flow rate from a circulation stop state, time until a position of the liquid surface sensor of the upstream side tank 25 is detected may be measured. If the time is longer than a predetermined range, there is abnormality from the circulating pump 35 to the upstream side tank 25 or there is abnormality in the operation of the pump. It is possible to use the pressure gauges for abnormality detection as described below. For example, when the upstream port is not connected, a pressure detected by the pressure gauge 31 does not rise even if the circulating pump 35 is operating. Thus, it is possible to learn abnormality earlier than judging the abnormality with the liquid surface sensor. It is also possible to judge that there is abnormality somewhere when readings of the liquid surface sensor and the pressure sensor are different from predictions. It is possible to measure time until the liquid surface sensor reaches a predetermined position after the circulating pump 35 is started and, when the time is not in a predetermined range, judge that there is abnormality. For example, when the circulating pump 35 is started from the circulation stop state and the liquid surface of the upstream side tank 25 does not reach the liquid surface sensor within a predetermined time, the circulating pump has failed in feeding the ink or there is ink leakage ahead of the upstream side channel. Conversely, when the upstream side tank 25 reaches the liquid surface sensor in time shorter than the predetermined time, it is possible to judge that the upstream side tank 25 is not hermetically sealed. Presence or absence of abnormality may be detected according to whether fluctuation in a liquid surface height or fluctuation in a pressure during circulation is within a predetermined range.

Figure 17:
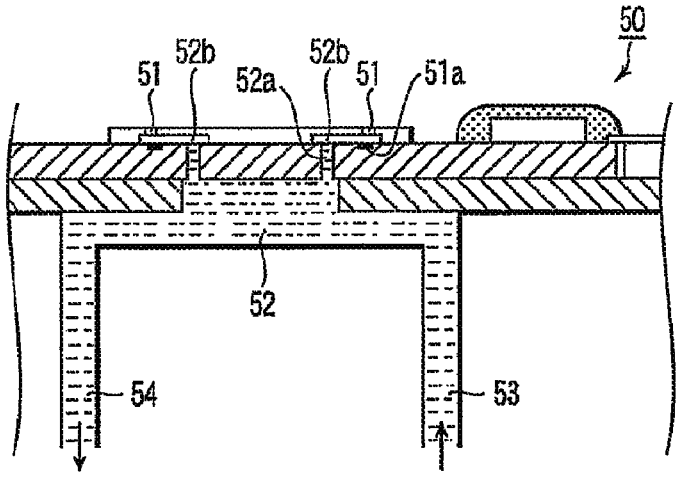
FIG. 17 is a partial sectional view showing a structure of an ink jet head according to a modification of the first embodiment.

In the example described in the embodiments, as shown in FIG. 2, the ink jet heads 11 to 16 eject the ink 20 while circulating the ink 20 via the pressure chamber 19. However, a method of supplying the ink is not limited to this. For example, like an ink jet head 50 shown in FIG. 17, it is also possible to apply a method of circulating and supplying the ink to an ink storing unit 52. The ink jet head 50 includes plural nozzles 51, heat generating elements 51*a* formed in association with the nozzles 51, the ink storing unit 52, and channels 53 and 54 that communicate with an upstream side and a downstream side of the ink storing unit 52. When the channels 53 and 54 are connected to the fourth conduit 40 and the fifth conduit 41 in the ink supplying mechanism 10 according to the embodiments, functions and effects same as those in the embodiments are obtained. In this form, pressure chambers 52*b* and the nozzles 51, in which meniscuses are formed, are provided via slits 52*a* to be spaced apart from the ink storing unit 52. It can be considered that the ink storing unit 52 is a branch point of the pressure chambers 52*b* and the nozzles 51 via an ink circulating section and the slits 52*a*. When the ink is circulated to such a head, if the heights of the ink storing unit 52 and the surface of the nozzles 51 are hardly different, a meniscus pressure at the branch point and a meniscus pressure in the nozzle are substantially equal when the ink is not ejected. Therefore, it may be considered that an ink pressure in the ink storing unit 52 is the meniscus pressure in the nozzles. When the ink is ejected, it may be considered that the meniscus pressure in the nozzles falls by a pressure obtained by multiplying an ejection flow rate by a channel resistance from the branch point to the nozzles.

Moreover, an ink jet head used for this ink jet apparatus may be a type that branches to an actuator and nozzles from the middle of a circulation path via a filter. In this case, if the heights of the filter and the surface of the nozzles 51 are hardly different, it may be considered that, in a state in which the ink is not ejected, a pressure in the nozzles is identical with a pressure in a section where a primary side of the filter is in contact with the circulation path. It may be considered that, when the ink is ejected, the pressure in the nozzles falls by a pressure obtained by multiplying an ejection flow rate by a channel resistance from the primary side of the filter to the nozzles. As the actuator 21, other than those described in the embodiments, for example, actuators of a piezoelectric type, a piezoelectric share mode type, a thermal ink jet type, and the like are also applicable.

When there are plural nozzle openings in the surface of an orifice plate and heights of the openings are different, it may be considered that an average of the heights of the nozzles is the height of the surface of the orifice plate as long as a difference in pressures near the nozzle due to the difference in heights does not exceed a range of proper pressures near the nozzle. In this case, when a direction of an ink circulation flow in a head is set in a direction from a section near a low nozzle to a section near a high nozzle, it is possible to reduce the difference in pressures near the nozzle due to the difference in heights. Thus, the direction of the ink circulation flow may be set in this way.

In the first embodiment, the circulating pump 35 is caused to operate according to a reading of the liquid surface sensor to obtain the gauge pressure PL of the air layer of the downstream side tank 30. However, there is also a method of providing a pressure sensor for measuring a gauge pressure of the air layer of the downstream side tank 30 instead of providing the liquid surface sensor and causing the circulating pump to operate only while a result of the measurement is larger than PL (a negative value) (an absolute value is smaller) to directly maintain the pressure PL.

Further, instead of judging an output of the liquid surface sensor or the pressure sensor with respect to a threshold to control on and off of the pump, the output of the liquid surface sensor or the pressure sensor is changed to an analog output. The circulating pump performs control for changing a flow rate according to the analog output value instead of the on and off control such that a flow rate of the circulating pump coincides with a target flow rate when the output of the liquid surface sensor or the pressure sensor is a predetermined value. This makes it possible to realize smooth control with less pulsation.

The constitution of each of the embodiments may be combined with the constitutions of the other embodiments. Specifically, plural ink jet heads may be provided in the first embodiment and the third embodiment. The supply pump 38 may be used and the supply tank 50 may be arranged below the ink jet head in the first embodiment and the second embodiment. Besides, the directions, the materials, the numbers, the specific shapes, and the like of the components may be changed without departing from the spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and equivalents thereof.

What is claimed is:

1. An ink supplying mechanism for an ink jet head for ejecting an ink while circulating the ink comprising:

a circulating system comprising:

an ink jet head having a nozzle, a pressure chamber fluidly communicating with the nozzle, and an upstream port and a downstream port that communicate with the pressure chamber;

an orifice plate in which the nozzle is formed, a surface of the orifice plate being clean prior to the circulating of the ink;

an upstream side tank that communicates with the ink jet head via the upstream port and stores an ink;

a downstream side tank that communicates with the ink jet head via the downstream port and stores the ink;

a circulating pump that feeds the ink from the downstream side tank to the upstream side tank; and a valve that opens and closes air of the downstream side tank with respect to atmospheric pressure; and a control device that is connected to the valve and the circulating pump and controls the circulating pump and an opening and closing operation of the valve, and that closes the valve and drives the circulating pump to make the liquid surface of the downstream side tank be a negative pressure, and feeds the ink from the downstream side tank to the upstream side tank via a feedback channel to circulate the ink.

2. An ink supplying mechanism according to claim 1, further comprising:

a liquid surface detector that detects height of a liquid surface of the ink in the inside of at least one of the upstream side tank and the downstream side tank; and the control device that controls circulating pump and opens and closes the valve according to the height of the liquid surface detected by the liquid surface detector.

3. An ink supplying mechanism according to claim 1, further comprising:

a pressure detector that detects a pressure in an air layer in the inside of at least one of the upstream side tank and the downstream side tank; and the control device that controls the circulating pump and opens and closes the valve according to the pressure detected by the pressure detector.

4. An ink supplying mechanism according to claim 1, further comprising plural ink jet heads, the upstream side tank being communicated with the plural ink jet heads via the upstream ports, and the downstream side tank being communicated with the plural ink jet heads via the downstream ports.

5. An ink supplying mechanism according to claim 1, the liquid surface of the upstream side tank is located above the orifice plate, and the liquid surface of the downstream side tank is located below the surface of the orifice plate.

6. An ink supplying mechanism according to claim 1, the ink supplying mechanism has a valve opening and closing the air of the upstream side tank with respect to an atmosphere, closes the valve to drive the circulating pump, and sets the liquid surface of the upstream side tank to a positive pressure.

7. An ink supplying mechanism according to claim 6, the ink supplying mechanism has a supply pump that feeds the ink in and feeds the ink from the circulating system, and the control device controls the supply pump such that a value obtained by dividing energy per unit of the ink on the liquid surface of the upstream side tank and energy per unit volume of the ink on the liquid surface of the downstream side tank by a channel resistance of an upstream side channel and a channel resistance of a downstream side channel maintains a proper nozzle pressure, wherein the energy per unit volume means a total value of a potential pressure and a static pressure.

8. An ink supplying method for supplying ink into an ink jet head for ejecting an ink while circulating the ink in an ink jet recording apparatus comprising:

constructing a circulation path that has an ink jet head having a nozzle formed in an orifice plate, a pressure chamber fluidly communicated with the nozzle, and an upstream port and a downstream port that communicate with the pressure chamber, an upstream side tank that communicates with the ink jet head via the upstream port and stores an ink, a downstream side tank that communicates with the ink jet head via the downstream port and stores the ink, and a circulating pump that feeds the ink from the downstream side tank to the upstream side tank;

cleaning a surface of the orifice plate before circulating the ink to prevent the ink from dropping from the nozzle;

making airtight the downstream side tank;

driving the circulating pump by a control device that controls the circulating pump and a valve that opens and closes the circulation path; and circulating the ink while controlling the liquid surface of the downstream side tank to have a negative pressure.

9. An ink supplying method according to claim 8, wherein energy per a unit volume of the ink on the liquid surface of the upstream side tank with height of the nozzle set as a reference is set to be smaller than a pressure necessary for the ink flowing out from the nozzle to drop.

10. An ink supplying method according to claim 8, wherein energy per a unit volume of the ink on the liquid surface of the upstream side tank with height of the nozzle set as a reference is set to be smaller than a pressure necessary for the ink flowing out from the nozzle to spread over a surface of an orifice plate in which the nozzle is formed.

11. An ink supplying method according to claim 8, wherein an ink pressure at a tip of the nozzle is within a range of 0 kPa to −3 kPa.

12. An ink supplying method according to claim 8, wherein a potential pressure on the liquid surface of the upstream side tank with height of the nozzle set as a reference is lower than a pressure necessary for the ink flowing out from the nozzle to drop.

13. An ink supplying method according to claim 8, wherein a potential pressure on the liquid surface of the upstream side tank with height of the nozzle set as a reference is lower than a pressure necessary for the ink flowing out from the nozzle to spread over a surface of an orifice plate in which the nozzle is formed.

* * * * *